United States Patent [19]

Pfeiffer

[11] Patent Number: 4,618,985

[45] Date of Patent: Oct. 21, 1986

[54] SPEECH SYNTHESIZER

[76] Inventor: J. David Pfeiffer, 64 Côte St. Charles, Box 470, Hudson Heights, Québec, Canada, J0P 1J0

[21] Appl. No.: 757,205

[22] Filed: Jul. 22, 1985

Related U.S. Application Data

[63] Continuation of Ser. No. 391,981, Jun. 24, 1982, abandoned.

[51] Int. Cl.[4] ..... G10L 5/00

[52] U.S. Cl. ..... 381/51; 364/513.5

[58] Field of Search ..... 381/51-53; 364/900, 513.5

[56] References Cited

U.S. PATENT DOCUMENTS

| | | | |
|---|---|---|---|
| Re. 30,991 | 7/1982 | Ostrowski | 381/53 |
| 3,491,205 | 1/1970 | Focht et al. | 381/51 |
| 3,524,932 | 8/1970 | Stucki | 381/51 |
| 3,652,801 | 3/1972 | Tscheschner et al. | 381/51 |
| 3,668,294 | 6/1972 | Kameoka et al. | 381/51 |
| 3,908,288 | 9/1975 | Brown | 381/51 |
| 3,916,099 | 10/1975 | Hlady | 178/18 |
| 4,398,059 | 8/1983 | Lin et al. | 381/51 |
| 4,435,616 | 3/1984 | Kley | 178/18 |

OTHER PUBLICATIONS

Flanagan, J., *Speech Analysis, Synthesis and Perception,* 2nd edition, Springer-Verlag, N.Y., 1972 pp. 341, 342, and 364.

*Primary Examiner*—E. S. Matt Kemeny

*Attorney, Agent, or Firm*—Fleit, Jacobson, Cohn & Price

[57] ABSTRACT

A speech synthesizer is disclosed in which instantaneous conversational speech can be produced by an operator. The speech synthesizer comprises a two dimensional input device, such as a joystick or a playing tablet, for producing vowel-like sounds, a plurality of selection keys for producing consonant-like sounds and a third control for varying the pitch or inflection of the produced signal. The electronic circuit for producing the voicing wave forms can be either analog or digital. The system features simultaneous and continuous control of two formants.

40 Claims, 15 Drawing Figures

SPEECH SYNTHESIZER

This application is a continuation of application Ser. No. 391,981, filed June 24, 1982, now abandoned.

FIELD OF THE INVENTION

The present invention relates in general to a speech synthesis system. In particular, the present invention relates to a device that produces a synthesis of natural-sounding speech that is usable in a conversational mode. More specifically, the present invention generates speech as a result of the manual input of an operator on an input device that is coupled to an electronic signal generating device.

BACKGROUND OF THE INVENTION

Since at least the year 1779, attempts have been made to duplicate speech by artificial means. The early machines utilized flexible resonators, usually shaped like the human vocal tract and reeds to simulate the vocal cords. At the 1939 World's Fair in New York, the Bell Telephone VODER (Voice Operated Demonstrator) was exhibited. This speaking machine had extremely complicated controls that could only be operated by a person with a high degree of skill who had been trained over a long period of time. The machine utilized a pitch-defining current that was sent to a vocal buzz generator above a certain level. Below that level, a hiss was substituted. Currents were provided to a bank of ten parallel audio filters used to define the strengths of the signal inside the bandpass range of that particular filter. At times, these filters had to be both turned on and off within an extremely short period of time, such as 1/20th second and rippled in arpeggios that would be difficult for even a skilled pianist to duplicate. One version of the VODER is disclosed in U.S. Pat. No. 2,121,142.

Current efforts at speech synthesis are almost unanimously directed toward electronic formation of intelligible speech from a continuous flow of digital impulses delivered by a computer, or from a stored digital representation of a person's voice. In the latter case, inverse filter techniques are used to divide the speech waveforms into signals to drive the synthesizer and reconstruct the voice waveform. However, these approaches have not been used to configure a speech-producing machine that can be continuously controlled. In many applications, the human speech is synthesized by the generation and combination of a plurality of sounds to represent basic speech parts, referred to as phonemes. The phonemes are then strung together to simulate words or phrases. By analyzing the phonemes required for intelligible speech, two major kinds of sounds were identified, namely voiced sounds which are primarily the result of vibration of the vocal cords resonating in the cavities that are formed, along the voice tract, and unvoiced sounds which are typically the sibilants and which tend to be basically derived from a random sound source such as white noise. A plurality of sine-wave generators of differing frequencies are used to provide a selected number of basic waveforms representative of the basic formants of sound. The waveforms are then combined to produce a resultant, complex waveform. One such synthesizer is disclosed in U.S. Pat. No. 4,092,495. A related approach is disclosed in U.S. Pat. No. 4,163,120 whereby stored speech waveforms representing basic functions are combined with other waveforms instantaneously produced by means of either time compression or time expansion of the stored basic functions.

A number of prior art devices utilize stored representations of operator selected words, phrases, phonemes and morphemes. An input device is usually provided which utilizes a keyboard having a plurality of individual touch sensitive locations, much in the manner of a typewriter. One such device is disclosed in U.S. Pat. No. 4,215,240.

Currently, digital speech synthesizer integrated circuits are commercially available from Texas Instruments Inc., General Instrument, National Semiconductor, A.M.I. and others. The Texas Instruments approach utilizes reflection coefficient-type data to control the characteristics of a digital filter. These devices are disclosed in a number of U.S. patents including U.S. Pat. Nos. 4,209,836, 4,304,965 and 4,328,395.

However, the recent synthesizers require either that the phrase to be spoken must either be stored in a memory or loaded into a register, thereby causing difficulty in real time conversation. Furthermore, these modern devices do not permit any individualistic input into the speech to permit inflections, feeling, and emphasis. For example, without using any fricative, plosive, or nasal consonants, a person can say "Where are you?"; but cannot say "Where are you?" or "Where are you?". Thus, although the prior art devices do permit some form of communication, they are not readily applicable in conversational communications with individualized characteristics.

SUMMARY OF THE INVENTION

The present invention overcomes the foregoing disadvantages of the prior art devices and permits feeling, interpretation, inflections, and smoothness to be added to speech sounds as they are being generated. The speech synthesizer of the present invention can be played much in the manner that a musical instrument can be played.

The present invention provides a means of contemporaneously speaking for voiceless people. The present invention permits a feedback response from the user so that continuous control over the desired response can be exercised. In one embodiment of the present invention, a playing surface is utilized over which the fingers of the user can be moved to command a two-dimensional control over the modeling of the vocal tract. This playing surface can also utilize a third variable determined by the amount of force on the playing surface to control, for example, the pitch and/or inflection of the voicing source. In this embodiment the two-dimensional playing area causes the generation of vowels, dipthongs, or semi-vowels (e.g., w, y, r, l). An additional selection area is provided for the production of fricative or plosive consonants.

In a prototype embodiment, the pitch of a voicing buzz and the amplitude of the voicing buzz are controllable as a single variable. The pitch/inflection variable is controlled by the amount of pressure on the playing surface.

The formation of the sounds "played" on the input device of the present invention can be done with a plurality of analog circuits using operational amplifiers, or through the use of digital simulators that are commercially available.

A speech generating system according to one embodiment of the present invention includes an input device continuously responsive to an operator, a means for simulating at least two resonant peaks or formants and for changing the frequency of the formants, a means for producing an electrical vibration signal and for varying the pitch period of the signal, and a means for combining the two signals. The produced complex waveform can be either stored in an analog or digitized form or can be sent to a speaker and immediately made audible.

These and other features, objectives, and advantages of the present invention will be set forth in or will be apparent from the detailed description of the presently preferred embodiments disclosed hereinbelow.

DETAILED DESCRIPTION OF THE PREFERRED EMBODIMENTS

Figure 1:
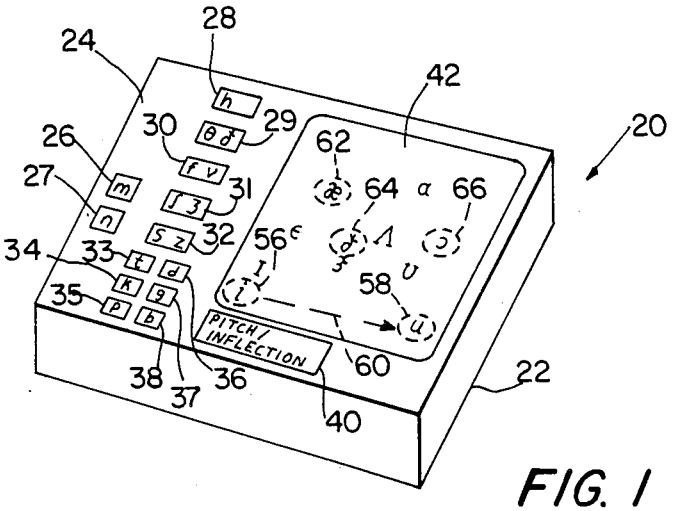
FIG 1 is a perspective view of a first embodiment of a manually operated, input board having a plurality of consonant selection keys and a two-dimensional "playing surface" for vowel selection.

Referring now to the figures in which like numerals depict like elements throughout the several views, and in particular with reference to FIG. 1, there is depicted a self-contained, portable speech synthesizer 20 comprised of a housing 22 and an input board 24. Contained inside housing 22 and not depicted in FIG. 1 is a power supply, such as batteries, the electronic circuitry such as on a circuit board, and a small speaker.

Input board 24 includes a plurality of consonant keys 26 through 38, a pitch/inflection control key 40, and a playing surface 42. Keys 26 and 27 are marked "m" and "n", respectively, and are for playing nasal consonants. Keys 29 through 32 are dual-acting keys mounted transversely about the center and playable by pressing on either side. If the left side of these keys is depressed, a fricative consonant will result and if the right side of these keys is depressed the selected voiced fricative consonant will be played. Keys 33 through 38 provide fricative or plosive consonants. The surfaces of keys 26 through 38 have indicia imprinted thereon taken from the standard International Phonetics Association (IPA).

Playing surface 42 has a plurality of indicia imprinted thereon from the standard IPA vowel symbols. Playing surface 42, is preferably comprised of a flexible membrane 46 that is part of a playing tablet 46, described in greater detail hereinbelow with reference to FIGS. 11, 12 and 13. The particular locations of the consonant selection keys 26 through 38 and the particular location of the IPA vowel symbols on playing surface 42 can be different than that depicted in FIG. 1. The best locations are a function of the ease of learning to play and the actual playing of synthesizer 20. Pitch/inflection control key 40 is located so that it can be operated by the thumb of either hand in much the same sense that a space bar of a conventional typewriter is operated.

Figure 2:
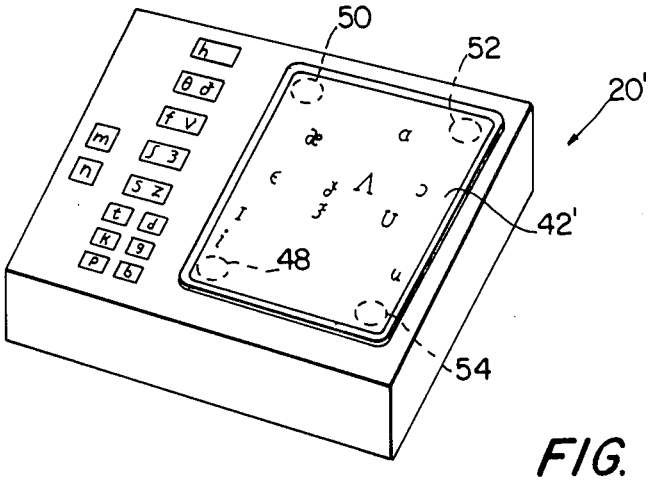
FIG. 2 is a perspective view of a second embodiment of an input board.

FIG. 2 depicts a second embodiment of a synthesizer 20′ that is substantially similar to synthesizer 20 depicted in FIG. 1. A major difference is that pitch/inflection key 40 has been replaced by four force-sensing transducers 48, 50, 52, and 54 located beneath the four corners of playing surface 42′. In synthesizer 20′, playing surface 42′ must be relatively rigid such that the total force exerted thereon can be conveyed thereby to transducers 48 through 54.

When finger pressure is exerted on playing surface 42 of either synthesizer 20 of FIG. 1 or synthesizer 20′ of FIG. 2, the corresponding synthesizer will emit a vowel sound chosen at a pitch and intensity controlled by the total amount of force on pitch/inflection key 40 or detected by transducers 48, 50, 52 and 54. For example, to produce a dipthong, a continuous path is traced by finger pressure on playing surface 42 from one vowel symbol to the next and, at the same time, maintaining an appropriate pitch with control key 40 or by controlling the total force applied to transducers 48, 50, 52 and 54. As an example, to "play" or sound the word "you", an operator would trace a horizontal path from the "i" symbol, at location 56, to the symbol "u," at location 58, the path of travel being indicated by arrow 60. According to the standard IPA, the symbol "i" has the vowel sound of "ee" as in the word "bee". On the other hand, if the exact reverse path is traced, the word "we" is produced. As a further example, tracing the path from the symbol "ae", at location 62, to the symbol "i" at location 56, produces or sounds the personal pronoun "I", which is a dipthong. As another example, if a path is traced from location 58 ("u") to location 62 ("ae") and then to location 56, ("i") the synthesizer will produce the word "why". As a final example, the sounds of the letter "r" and "l", known as laterals, can be produced in the general vicinity of locations 64 and 66, respectively. These laterals can be stressed as initial consonants simply by a rapid motion from their respective locations to the next vowel sound. Other words would be obviously formed depending upon the particular path traced by a finger of the operator on playing surface 42.

Force transducers 50, 52, 54 and 56 depicted in FIG. 2 can be any one of a number of commercially available devices. For example, they can be a variable resistance transducer, such as short stroke linear potentiometers having springs connected across the mechanical input such that the output resistance (or voltage if connected as a potential divider) is proportional to the force on the springs. In addition, a direct current differential transformer (DCDT) or a self-demodulating LVDT can be used. Other devices include a transducer constructed of variable resistance materials such as a conducting foam positioned between two metallic plates and having a lower electrical resistance in proportion to the compressional force exerted on the metallic plates. Alternatively, cells containing carbon plates or granules much like those used in the early telephone transmitters can be utilized. Finally, a semiconductor bending beam transducer (such as a Pixie transducer manufactured by Endevco), piezoelectric or piezoresistive bending beam elements (such as those made by Gulton Labs of Metuchen, NJ), or strain gages in beams, rings or bars arranged to measure their deflections and hence the applied force can be used. Other force transducers which are usable in the present invention would be obvious to those of ordinary skill in the art.

Figure 3:
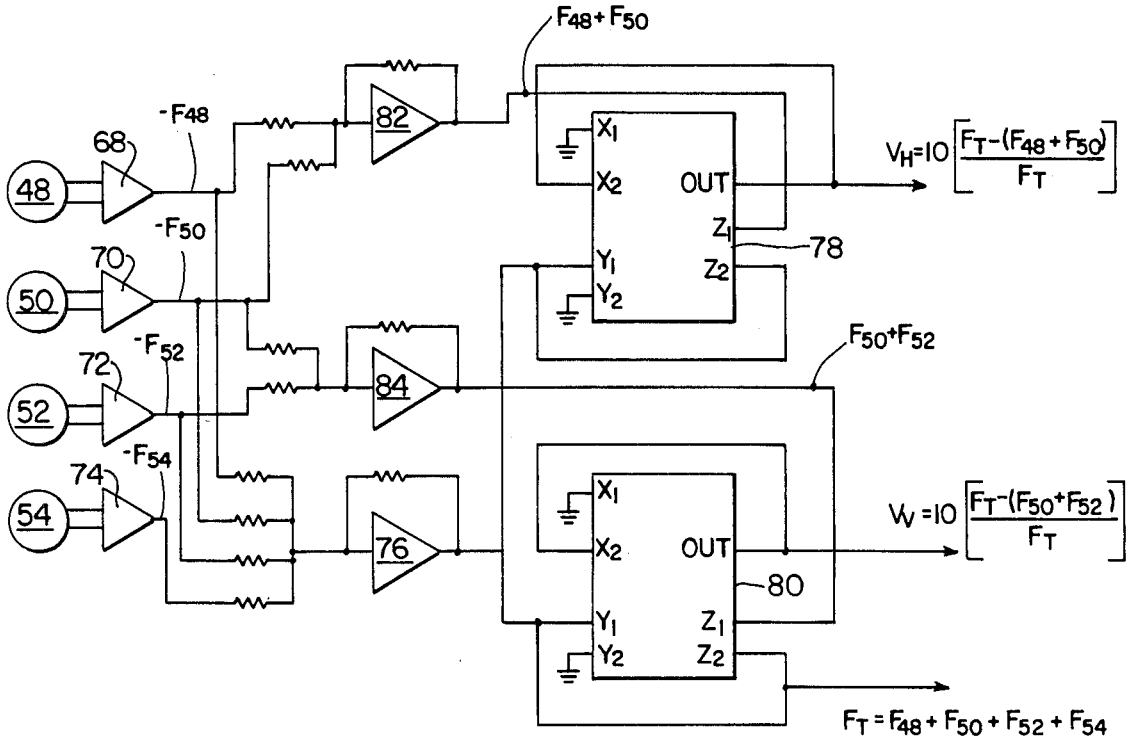
FIG. 3 is a schematic, electrical block diagram of an electronic circuit for decoding force and location parameters produced by the input board depicted in FIG. 2.

The four transducers 48, 50, 52 and 54 utilized in synthesizer 20' of FIG. 2 can provide both the total amount of applied force on playing surface 42 and a resolution of the force location in the x and y axes. An electrical circuit to accomplish this is depicted in FIG. 3. The output of transducers 48, 50, 52 and 54 are respectively amplified in instrumentation amplifiers 68, 70, 72 and 74. The inverses of the respective voltages appearing at the output of instrumentation amplifiers 68, 70, 72 and 74 are indicated respectively as $-F_{48}, -F_{50}, -F_{52}$, and $-F_{54}$. The voltage outputs from instrumentation amplifiers 68, 70, 72, and 74 are summed in a summing operational amplifier 76, the output voltage of which represents the total applied force, $F_T$, applied on top of playing surface 42. The output from summing amplifier 76 is provided to the $Y_1$ and $Z_2$ inputs of conventional four-quadrant integrated circuit multiplier-dividers 78 and 80. Summing amplifier 76 can be a conventional operational amplifier of the 741, 747, or TL-074 type connected as an inverting amplifier with nominal unity gain (input resistance being equal to the feedback resistance). Instrumentation amplifiers, on the other hand, should preferably have a precision and a high gain with low drift, such as the operational amplifier LH0038 manufactured by National Semiconductor. Multiplier-dividers 78 and 80 are preferably of the type AD534K or AD534L manufactured by the Analog Devices Corporation of Norwood, Mass. Multiplier-dividers 78 and 80 are connected as percentage computers whereby the outputs are equal to a scale factor, (which in the present embodiment is a full scale of 10 volts), times the ratio of the inputs.

The output of instrumentation amplifiers 68 and 70 are also connected to and summed by a summing amplifier 82. Similarly, the output from instrumentation amplifier 70 is summed with the output from instrumentation amplifier 72 by a summing amplifier 84. Summing amplifiers 82 and 84 can be identical to and identically connected as summing amplifier 76. The outputs from summing amplifiers 82 and 84 are respectively connected to the $Z_1$ inputs of multiplier-dividers 78 and 80. The outputs from multiplier-dividers 78 and 80 are representative of coordinate locating signals that are respectively proportional to the horizontal position, $V_H$, on a scale of, for example, 0 volts to 10 volts and to the vertical position, $V_V$, on a scale of, for example, 0 volts to 10 volts. As mentioned above, because of the connection of multiplier-dividers 78 and 80 as percentage computers, their respective outputs are equal to the scale factor times the ratio of total force minus the two selected forces divided by the total force. Such an output is independent of the magnitude of the force. The output $V_H$ of multiplier-divider 78 is near 0 when the force is applied on the line between transducers 48 and 50 (near location 56) and is near the scale factor when the force is applied on the right side, near location 58. Similarly, the output signal $V_V$ from multiplier-divider 80 is near 0 for forces applied at the top of playing surface 42 along a line drawn between transducers 50 and 52, and is near the scale factor when the force is applied near the bottom of playing surface 42 on a line between transducers 48 and 54. The output signals $V_H$ and $V_V$ are applied as control voltages to tunable filters to adjust the formant positions in the vocal tract circuitry of the synthesizer and the output signal $F_T$ is applied to a voicing source circuit to adjust the frequency or pitch, discussed hereinbelow.

Figure 4:
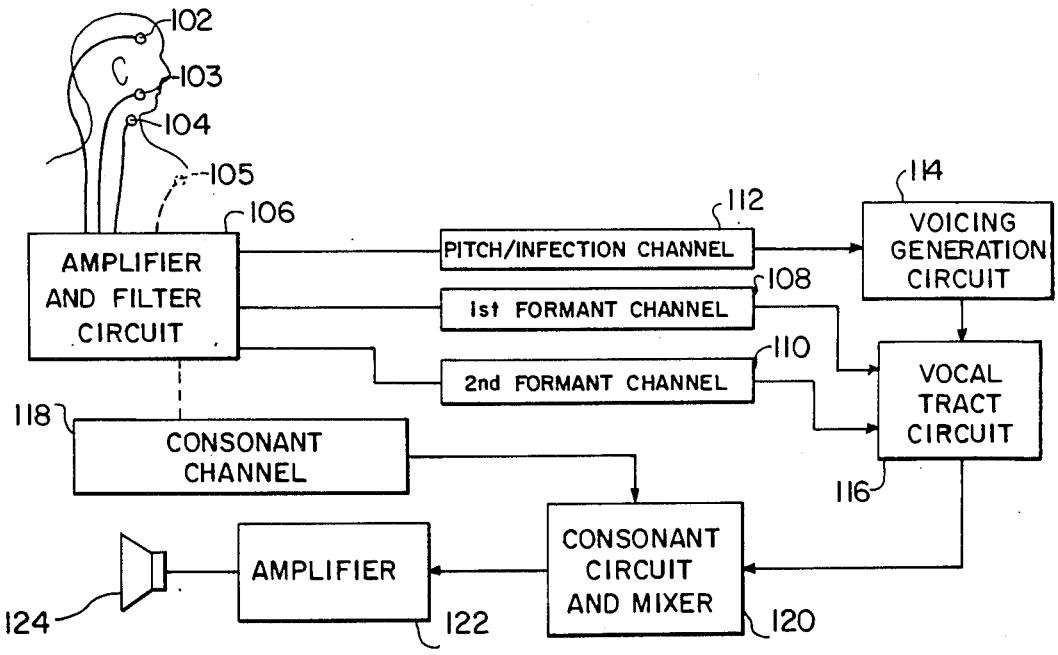
FIG. 4 is an electrical schematic block diagram for producing synthesized speech as a result of operator produced myo-electric or neuro-electric voltages.

FIG. 4 depicts an alternate method of providing input signals to a voice synthesizer. In this embodiment, conductive pickup pads 102, 103, 104 and 105 are placed at appropriate locations on the skin of the operator. Pickup pads 102 through 105 detect electrical signals produced by the firing of muscles (myo-electric signals) or from the firing of nerve axons or neurons (neuroelectric signals). These are the same signals which are recorded in electroencephalographs. The pickup points on the user are determined using the criteria of the best signal separation and the best voluntarily controlled signals.

Pickup pads 102 through 105 are connected to the inputs of an amplifier and filter circuit 106. Circuit 106 filters out the high frequencies and provides amplified signals having frequencies in the range of interest. The signals from transducers 102, 103, and 104 roughly correspond to the three output signals $V_H$, $V_V$, and $F_T$, in FIG. 3, and are applied to two formant control channels 108 and 110, and to a pitch/inflection channel 112. The output of pitch/inflection channel 112 drives a voicing generation circuit 114 which in turn produces a voicing buzz that increases in pitch or repetition frequency with an increasing output voltage from pitch/inflection channel 112. Voicing generation circuit 114 drives a vocal tract circuit 116. Vocal tract circuit 116 includes at least two tunable filters that are respectively controlled by the output signals from formant channels 108 and 110 to produce vowel-like sounds.

Pickup pad 105 is optional and is used to provide a consonant control signal for the operator unable to make himself or herself understood by just using the vowel-like sounds produced by vocal tract circuit 116. Pickup pad 105, when used, is connected through amplifier and filter circuit 106 to a consonant channel 118. Consonant channel 118, in its simpliest embodiment, can provide a plurality of consonants based on a simplified voltage threshold detection circuit in consonant circuit and mixer 120. Circuit 120 mixes the output from consonant channel 118 with the output from vocal tract circuit 116 and provides an output to an amplifier 122, connected in turn, to a speaker 124.

For example, the selection and mixing of a signal from consonant channel 118 could be done on the basis of the voltage threshold of the amplified signal from pickup pad 105. At low voltage levels, no consonant sound is produced and the output signal from the vocal tract circuit 116 is permitted to go directly to amplifier 122. At a higher voltage level of the amplified consonant control signal, a hissing sound could be produced by consonant circuit 120 and mixed with the output from vocal tract circuit 116. Such a hissing sound could simulate the sound of the letters "s" or "f" in certain words. At a still higher voltage level, consonant circuit and mixer 120 could produce a timed pause followed by a short plosive noise burst and mix it with the output signal from vocal tract circuit 116. The timed pause and short plosive noise burst would simulate the sound produced by the letters "g","k", or "p,b,d, or t." Although such a system is a very crude method of voice synthesis, it would still permit many, extremely handicapped persons to communicate a little.

Figure 5:
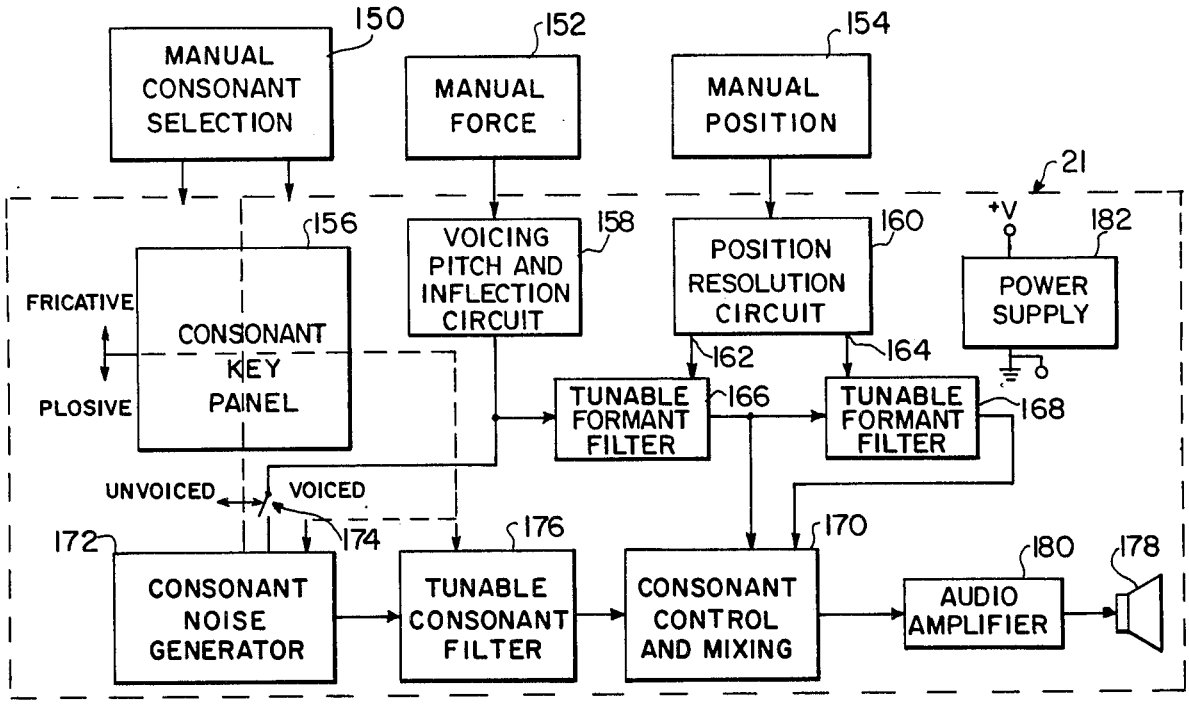
FIG. 5 is an electrical schematic block diagram of an embodiment of a speech synthesizer according to the present invention.

With the above descriptions of FIGS. 1 through 4 as a basis, a more detailed discussion of a voice synthesizer according to the present invention can now be undertaken with reference to FIG. 5. The operator inputs to voice synthesizer 20 are schematically shown in boxes 150, 152, and 154 as a consonant selection, a force application, and a force location, respectively. The operator would apply the consonant selection, using the synthesizer configuration of FIG. 1, to one of the consonant keys 26 through 38. The force application would be applied to pitch/inflection control key 40 and the force location would be the x, y coordinates of a force applied to playing surface 42. The particular consonant key selected, as discussed above, will be either a fricative or plosive, voiced or unvoiced consonant. This is schematically shown in FIG. 5 by a four quadrant consonant key panel 156. Consonant key panel 156 does not depict nasal consonants keys 26 and 27 in order to maintain simplicity in the circuit. These consonant keys are, however, depicted in the detailed electrical schematic circuit depicted in FIG. 8 and discussed below. As discussed below, nasal consonant keys 21 and 22 operate directly on the formant filters.

The amount of force applied is detected in the voicing pitch and inflection circuit 158. Circuit 158 generates a voicing waveform or buzz having a substantially constant amplitude and a frequency that varies proportionally to the magnitude of the force applied. Circuit 158 incorporates time constants to allow the frequency to decrease smoothly to a near-zero, non-oscillating condition upon the removal of all input force. In the preferred embodiment of circuit 158, the circuit also includes means to detect a predetermined, minimum amount of force before permitting the frequency of the waveform to be increased above its near-zero, non-oscillating condition.

The force location input indicated at box 154 is applied to a position resolution circuit 160. Position resolution circuit 160 provides two outputs 162 and 164, corresponding for example, to the X coordinate and the Y coordinate on playing surface 42 in FIG. 1. Such a circuit, on the other hand, could be that depicted in FIG. 3, which circuit would be used in conjunction with the synthesizer 20' depicted in FIG. 2. Outputs 162 and 164 from circuit 160 are respectively coupled to the control inputs of a first formant filter 166 and a second formant filter 168. The signal input to first formant filter 166 is provided by the signal generated by voicing pitch and inflection circuit 158, described hereinabove. The signal input to second formant filter 168 is provided by the output of first formant filter 166.

Formant filters 166 and 168 preferably have narrow bandpass characteristics similar to the resonances of the human vocal tract from the vocal cords to the constriction formed by the hump of the tongue (first formant), and similar to the resonances of the human vocal tract from the hump of the tongue to the front of the mouth (second formant). Other properties of these filters can include the ability to transmit frequencies outside the bandpass range in an attenuated magnitude, and some fixed filtering to model other non-tunable resonances. The location of the adjustable center frequencies of the bandpass filter (i.e., the tuning of the filter) is continuously variable by the control input signals generated by position resolution circuit 160. The feature of having continuously variable center frequencies of the formant filters, especially during the pronunciation of vowel sounds, imparts a natural and smooth sound, similar to normal speech, and is somewhat analgous to the muscles of the mouth and throat almost always being in motion while speaking is occurring.

As mentioned above, the output of first formant filter 166 provides the input signal for formant filter 168. This arrangement is known as a series or cascade filter. However, a parallel filter could also be utilized simply by having the output from voicing pitch and inflection circuit 158 providing the signal input to both formant filters 166 and 168 in parallel.

The output from first formant filter 166 is also provided to a controllable mixer 170. The output from second formant filter 168 is also coupled to the input of mixer 170. A third input to mixer 170 is derived from the selected consonant.

The consonant selected in key panel 156 has a corresponding noise waveform generated in a pseudorandom noise generator 172. Noise generator 172 can be a commercially available circuit that is comprised of a shift register having 20 to 45 stages, with about 3 exclusive-OR gates at selected locations and a means for determining the polarity of a signal to be shifted into the input by comparing the even or odd count of the bits at the 3 sample locations. The result is a long binary number having from 1000 to 2000 bits with the 1's and 0's occurring randomly, but repeating as the resultant number recirculates in the shift registers to form a bit stream. When the bit stream is passed through an audio amplifier, the result is the hissing sound of white noise.

The consonant sounds are implemented by inserting the filtered white noise into mixer 170. Unvoiced fricative consonants can be sounded continuously, as long as their respective contacts of switches 28 through 32 of FIG. 1, for example, are held closed. However, vowel sounds must be suspended while unvoiced fricative consonants are being spoken in order to simulate actual speech. This is accomplished by interrupting the contributions from filters 166 and 168 in mixer 170. In FIG. 1, the unvoiced fricative consonants appear on the left-hand side of keys 28 through 32. For example, the unvoiced fricative consonant of key 29 is the "th" as in the word "*th*eatre" and the fricative consonant of key 31 id the "sh" as in the word "*sh*e".

Voiced fricative consonants appear on the right-hand side of keys 28 through 32 and are treated in a similar way as the fricative consonants, except that the consonant noise is used to modulate the voicing waveform. Exemplary voiced fricatives are the right hand side of key 31 which represents the letter "z" as in the word "azure", and the letter "z" on the right-hand side of key 32 as used in the word "zoo".

The clock frequency determining the shift rate of noise generator 172 is selected according to the range of frequencies contained in the respective consonant. For example, the consonant "h" has the lowest clock frequency, the consonant "θ" has a relatively high clock frequency, and the consonants "f" and "s" have an intermediate clock frequency. If the consonant is voiced, the voicing waveform is modulated by the output of noise generator 172, as indicated schematically by switch 174.

The output from noise generator 172 is coupled to the input of a tunable consonant filter 176. Consonant filter 176 further modifies the frequency content of the signal by passing the signal through a bandpass filter, the center frequency of which can be set at an appropriate value for the selected consonant. For example, the consonant "h" has a low center frequency because it is formed in the back of the mouth cavity. On the other hand, the consonant "s" has a high center frequency since it is formed between the teeth and the lips.

As mentioned above, the output of consonant filter 176 is fed to an input of controllable mixer 170. Mixer 170 includes a means to control the timing of plosive consonants (unvoiced plosives t, k, and p as represented by keys 33 through 35 in FIG. 1; and voiced plosives d, g, and b as represented by keys 36 through 38 of FIG. 1). Plosive consonants are characterized by a stop in the flow of sound while the air pressure is being built up. The built up air pressure is then released in a short burst of sound. While the key switch contact for a plosive consonant is held down, the sound is interrupted and the short burst of sound is timed by timers once the key is released. Timers must be used since the time duration is too short to be controlled accurately by the corresponding key switch.

Mixer 170 sums all of the inputs thereto and provides the summed signal at the output thereof. The output of mixer 170 is coupled to a small speaker 178 through a conventional audio amplifier 180. An exemplary audio amplifier would have a power rating of about 100 milliwatts to 1 watt.

A power supply 182 for synthesizer circuit 21 is shown schematically with a plus voltage and ground outputs. Preferably, power supply 182 is comprised of batteries.

Figure 6:
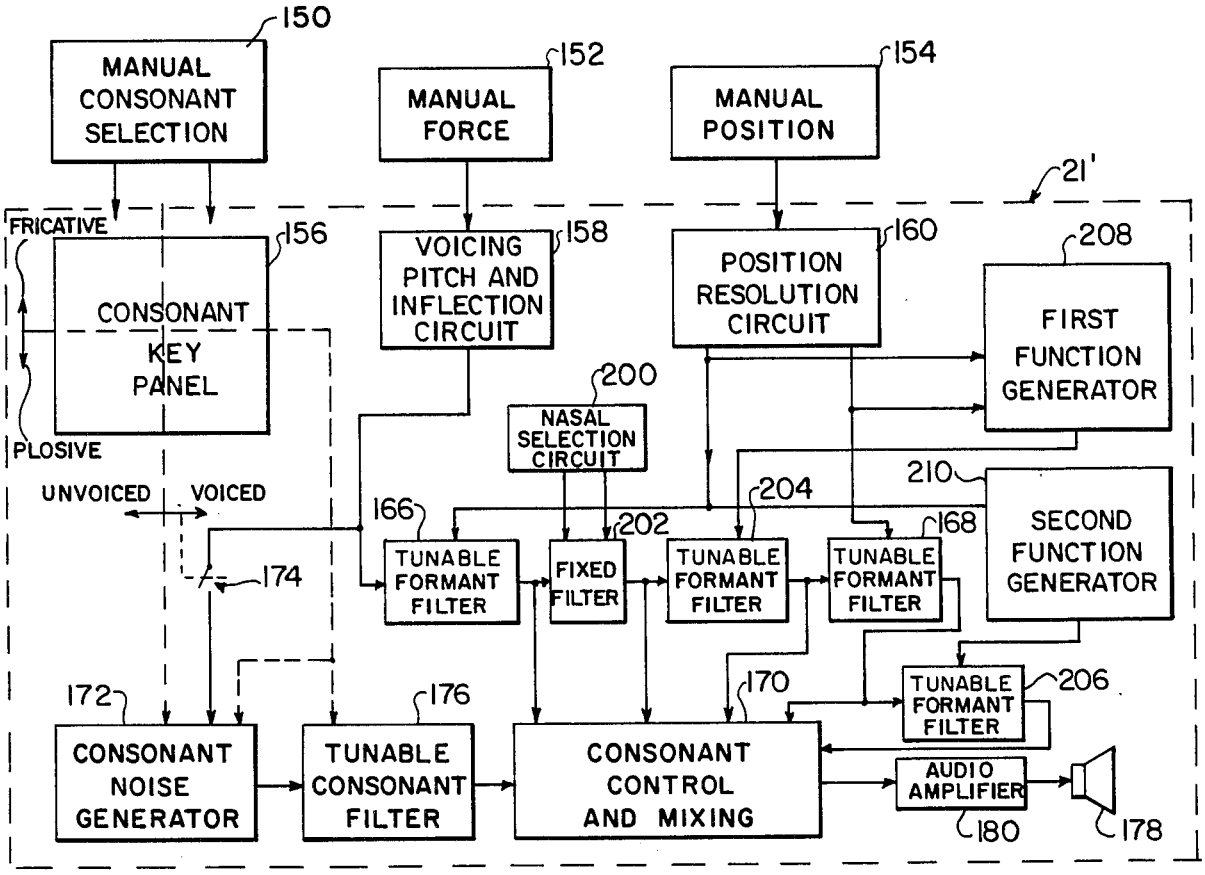
FIG. 6 is an electrical schematic block diagram of another embodiment of a speech synthesizer in accordance with the present invention.

With reference now to FIG. 6, an electrical block diagram of a synthesizer circuit 21' is depicted that is similar to, but more detailed than, the electrical block diagram of a synthesizer circuit 21. Synthesizer circuit 21' also incorporates a nasal consonant selection circuit 200 coupled to a fixed filter 202 that is connected between first formant filter 166 and a third formant filter 204. The output of a third formant filter 204 is coupled to the signal input of second formant filter 168, whose output is now also connected to the signal input of a fourth formant filter 206. The control signal for third and fourth formant filters 204 and 206 is respectively provided by a first function generator 208 and a second function generator 210, the inputs of which are both coupled to the outputs of position resolution circuit 160. Stored information in function generators 208 and 210 provides the tuning or control signals for third and fourth formant filters 204 and 206.

Thus, when the first two formants are determined by the output of position resolution circuit 160, two additional formants are created which help augment and refine the simulation of the vowel formation. Function generators 208 and 210 can be implemented with a digital storage means, retrieved as a function of two digital addresses derived from the output signals of position resolution circuit 160 by an analog-to-digital conversion, or may be extensions of conventional, well-known variable slope function generators having diode isolation between adjustable segments. Such function generators are normally single variable inputs, single outputs. However, simple algorithms can be incorporated by having a second input modify the slopes or break points, or multiply the analog output signal. Also, the outputs of two of the single variable filters can be multiplied.

Fixed filter 202 adds a simulation of the nasal resonances of the head cavity and sinuses. When the nasal consonants, such as keys 26 and 27 of FIG. 1, are selected, the characteristics of fixed filter 202 are changed in the circuit so as to simulate a nasal sound.

Outputs from all of the filters, namely formant filters 166, 168, 204 and 206, and fixed filter 202, are all coupled to controllable mixer 170 for being fixed together with the output from consonant filter 176. The particular order of the various filters can be varied from that depicted in FIG. 6 so as to improve certain speech synthesization, as would be obvious to one of ordinary skill in the art. Further, third and fourth formant filters 204 and 206 could be placed last because their signal amplitudes is only a small percentage of the total signal developed by controllable mixer 170.

Three different embodiments of tunable formant or consonant filters are depicted in FIGS. *7a*, *7b*, and *7c*. The various R-C values are selected to place the nominal frequency range of the filter in a desirable, predetermined range.

In FIG. *7a*, the tunable filter control signal is provided by the output of a joy stick controller when the joy stick is moved, for example, in the upward direction. The motion of the joy stick (not shown) is resolved into the rotation of potentiometer 302. The lower the resistance of potentiometer 302, the higher will be the frequency produced by the filter.

The basic filter circuit is comprised of three operational amplifiers 304, 306, and 308 connected in a loop. This circuit is similar to the circuit used to generate sine and cosine signals in analog computers. Such a circuit is comprised of two operational amplifiers connected as integrators and one operational amplifier connected as an inverting amplifier. In the circuit of FIG. *7a*, amplifiers 304 and 308 are connected as integrators and amplifier 306 is connected as an inverting amplifier.

The oscillation of the circuit is begun with an initial voltage on one of the integrator capacitors. Once started, an input is not necessary since the circuit oscillates at a constant amplitude. However, by adding damping or dissipation to a single frequency circuit, such as that provided by resistors 310, 312, and 314, the oscillations die out and other frequencies near the center frequency are transmitted with attenuation. An input signal is applied at resistor 316 and can drive the circuit. The output of the circuit is taken at point 318 located at the output of operational amplifier 306.

The loop gain of the filter circuit depicted in FIG. *7a* varies according to the ratio of the resistance of resistor 320 divided by the sum of the resistances of resistors 320 and 302. The loop gain also sets the center frequency of the circuit. Resistor 322 prevents division by zero (which results in howling). The tuning range of the circuit depicted in FIG. *7a* is a maximum of 50:1 in frequency with the values of resistors 322 and 302 being 1.8 kiloohms and 100 kiloohms adjustable, respectively. The filter input and the loop feedback from amplifier 308 are added through two identical, high resistance resistors 316 and 324, respectively.

Operational amplifier 304 has an R-C series combination as a feedback which tends to give increasing damping at frequencies higher than the center frequency. The output from operational amplifier 304 is amplified and inverted by amplifier 306. The amplified signal from amplifier 306 is not only taken as the filter output at 318, but is also fed to the input of operational amplifier 308 through an input resistor 326. Operational amplifier 308 has an R-C parallel combination in its feedback circuit which tends to give increasing damping at frequencies lower than the center frequency. Although the feedback circuit around operational amplifier 308 need only consist of a single capacitor and a single resistor in parallel, the feedback circuit depicted around operational amplifier 308 is more complicated so as to give a somewhat broader bandwidth formant with less annoying ringing.

The formant filter depicted in FIG. *7a* is preferably used as first formant filter 166. Preferably, second formant filter 168 and consonant filter 176 utilize only a parallel R-C feedback around operational amplifier 308.

Other devices can be substituted in the circuitry of the tunable formant filters once it is realized that the control of the filter comprises changing the gain from the output of amplifier 304 to the input of amplifier 308. Voltage control of the gain is provided for in FIG. *7b* and digital control of the gain is provided for in FIG. *7c*.

With respect to FIG. *7b*, inverting amplifier 306 of FIG. *7a* has been replaced by a four-quadrant analog multiplier-divider 352 configured as a divider so that the output center frequency is proportional to the reciprocal of the control voltage supplied at the input 354. An adjustable potential divider, comprised of potentiometer 356 and resistors 358 and 360, is provided at the inverting X-input of multiplier-divider 352 so that division by zero cannot occur if the control voltage at input 354 goes to zero. Multiplier-divider 352 is preferably of a type similar to Analog Devices AD534.

Alternatively, the gain of the circuit depicted in FIG. *7b* can be set by configuring multiplier-divider 352 as a multiplier. However, this would change the locations of the vowel formants on playing surface 42 (FIG. 1). The vowel formants would be crowded to one edge and there would be poor resolution between the different IPA symbols if the tuning voltage varied linearly and controlled the gain multiplicatively. A simple and inexpensive device to control the gain as a function of the bias current in a circuit configured as a multiplier, is operational amplifier CA3060, a three operational transconductance amplifier array manufactured by RCA. Since the control voltage of 10 volts at input 354 produces a unity gain in multiplier-divider 352, the resistance of resistor 326' has been increased to 22 kiloohms from the 10 kiloohm resistance used for resistor 326 in FIG. *7a*.

In FIG. *7c*, a twelve-bit multiplying digital-to-analog converter 376 is used to digitally set the input and feedback resistors for operational amplifier 306. Such a converter could be commercially available type AD7541 manufactured by Analog Devices. An eight-bit device can also be used, but a resolution of 256 different center frequencies would be provided instead of 4096 different center frequencies provided by a twelve-bit converter. Converter 376 is configured as a divider, so that the gain is inversely proportional to the value of the digital word. Alternatively, digital multiplication of the gain could be employed. Since the gain of converter 376 with all bits on is (minus) unity, the value of resistor 326' has been changed from 10 kiloohms of resistor 326 in FIG. *7a* to 22 kiloohms in FIG. *7c*.

Figure 8:
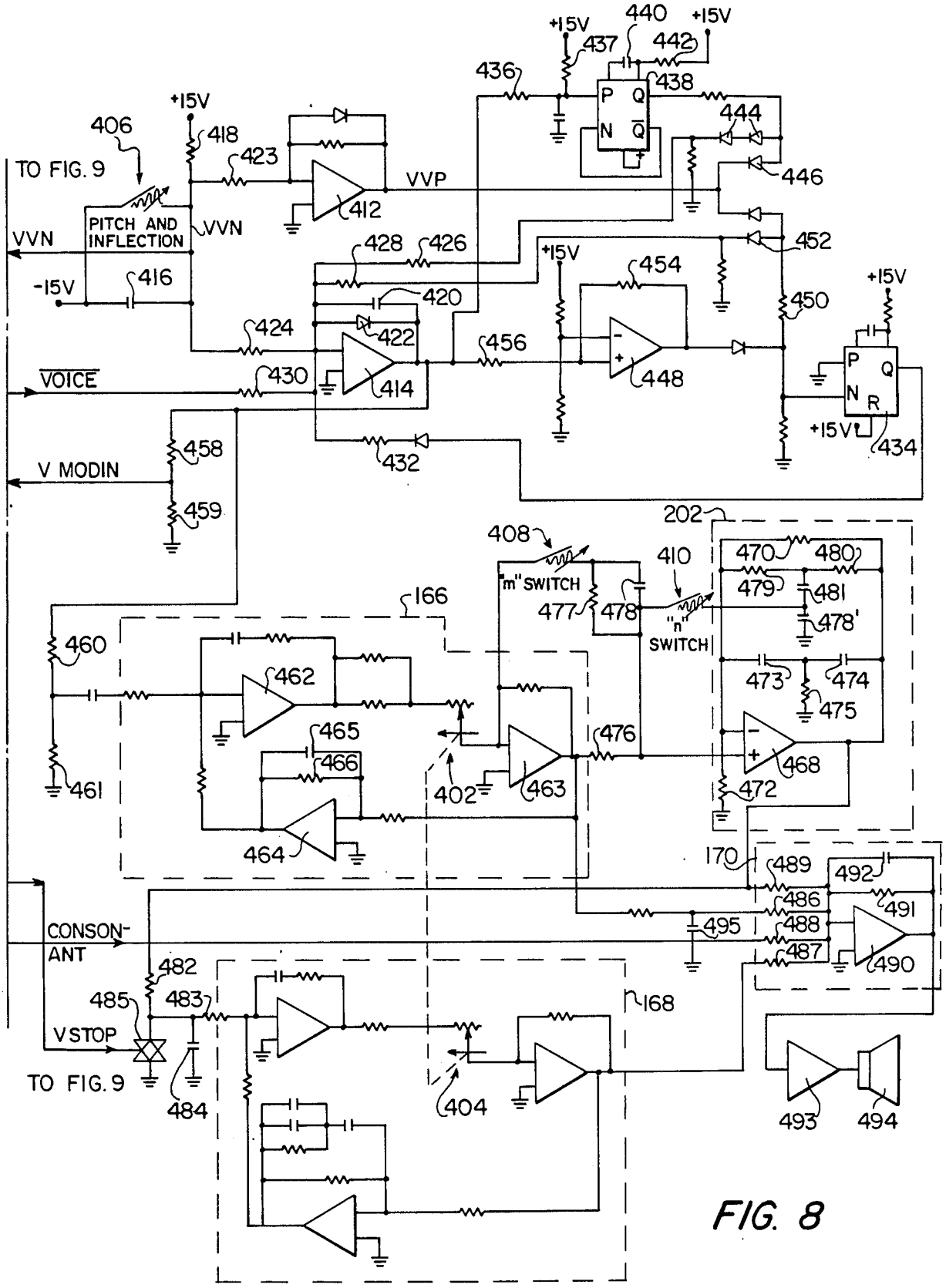
FIG. 8 is an electrical schematic circuit diagram of part of the synthesizer similar to the block diagram circuit depicted in FIG. 5 and depicting the voicing and vocal tract filters.
Figure 9:
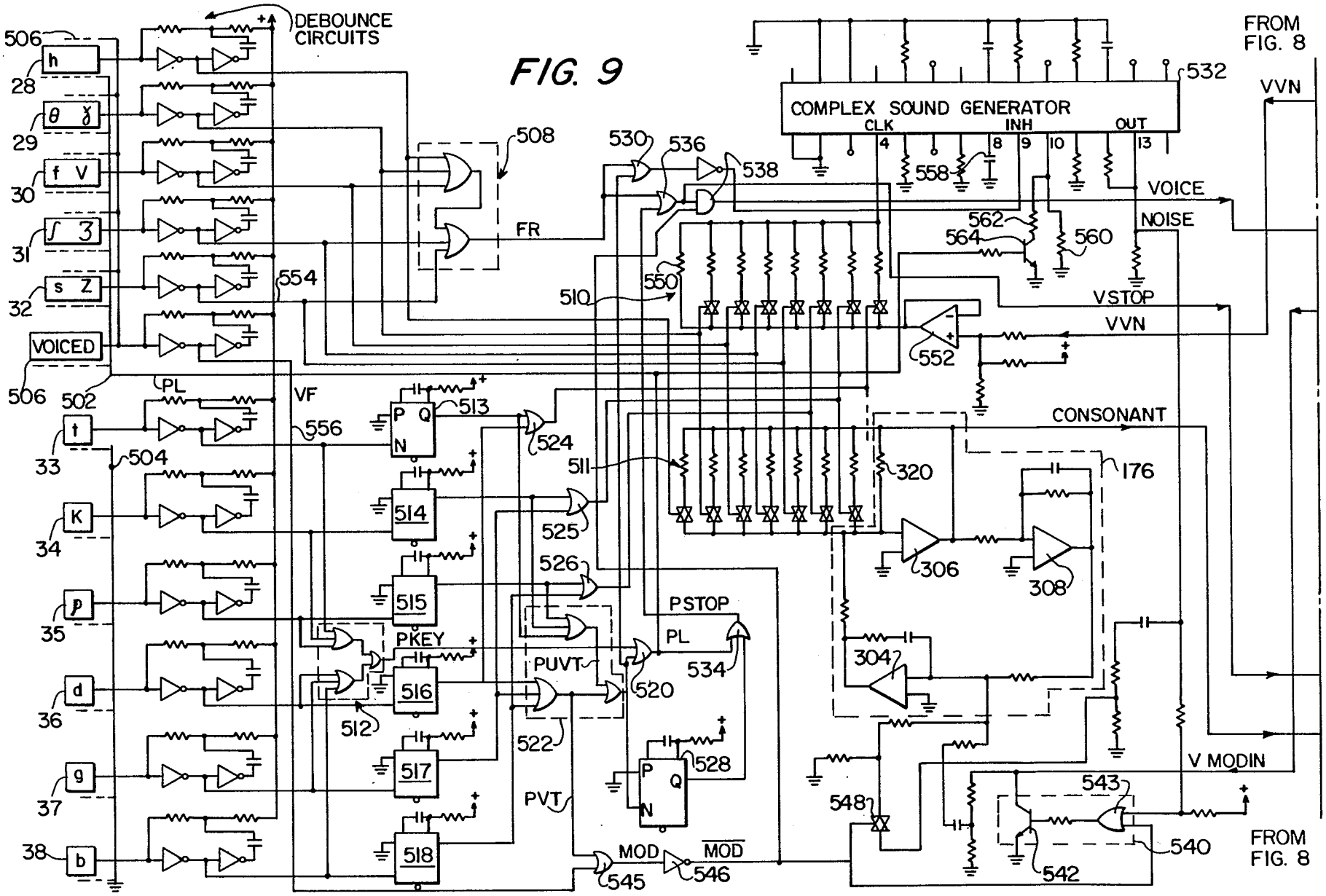
FIG. 9 is an electrical schematic circuit diagram of the other part of the synthesizer similar to the block diagram circuit depicted in FIG. 5 and depicting the consonant selection part of the circuit.

With reference now to FIGS. 8 and 9, a detailed, schematic electrical circuit diagram is depicted of a speech synthesizer according to the present invention. In this embodiment, the manual position information.is obtained from the mechanical resolution of the handle position of a joy stick control not shown. The rotational angle of the joy stick position is resolved by two 100 kiloohm potentiometers 402 and 404, depicted schematically in FIG. 8. Potentiometer 402 responds to vertical motions of the joy stick (not shown) and is electrically located in the circuitry of first formant filter 166 (FIG. 6). Potentiometer 404 responds to the horizontal motions of the joy stick control and is electrically connected in the circuitry of second formant filter 168. Thus, in this embodiment of the invention, the position resolution circuit 160 of FIG. 5 has been replaced by a mechanical resolution of the input.

In a similar manner, the pitch/inflection control key 40, and the "m" and "n" nasal consonant keys 26 and 27 have been replaced by specially designed, pressure-sensitive resistance switches 406, 408 and 410, respectively. This switch (not shown) comprises a spring metallic conductor strip mounted on a block of carbon-impregnated foam. This foam is commercially available and can simply be of the same type as is used for shipping integrated circuit chips. Circuit pins integral with the metallic conductor penetrate into the foam to connect the conductor to the foam. A second metallic strip is located on the opposite side of the foam block, and the two strips form the two switch terminals. An exemplary size of the foam block is $2\times3\times0.5$ cm. The resistance between the two strips begins at essentially infinity (open circuit) and is reduced to about 50,000 ohms at the first light contact. The resistance decreases with increasing force, down to a lower useful value of about 1,000 ohms. Pitch/inflection switch 406 has a function and produces a result similar to the expression pedal of an organ. Such a switch provides a clickless switching.

The circuit depicted in FIG. 8 will now be described. Pitch/inflection switch 406 is connected between a negative 15 volt power supply and the inputs of two operational amplifiers 412 and 414. This negative voltage is denoted VVN (Voicing Voltage Negative). A capacitor 416 connected around pitch/inflection switch 406 smooths the VVN signal so that it changes in a stepless fashion. The output from pitch/inflection switch 406 is drained to a +15 volts through a resistor 418 when pitch/inflection switch 406 is not being operated so as to assure that VVN signal goes to zero volts. Operational amplifier 412 is connected in the circuit as an inverter and produces a positive VVP output signal. Operational amplifier 414 is connected as an integrator as a result of a feedback capacitor 420. A diode 422 in the feedback circuit of operational amplifier 414 prevents the output thereof from going negative. In addition to a resistor 424 connected to the output of pitch/inflection switch 406, four other inputs are provided to operational amplifier 414 through resistors 426, 428, 430, and 432. The input to operational amplifier 414 through resistor 432 is connected to a monostable, multivibrator or one-shot 434. One-shot 434, when it is conducting, turns operational amplifier 414 off during which time diode 422 clamps the output voltage thereof to a slight negative value (−0.6 volts). When operational amplifier 414 is not being held in a non-conducting condition, the output voltage from it changes linearly with time whenever there is a constant imbalance of the currents through resistors 426, 428, 430 and 432 at its input.

One output from operational amplifier 414 is connected through voltage dividing resistors 436 and 437 to trigger a second monostable multivibrator or one-shot 438. One-shot 438 is set to provide a 0.3 ms pulse at its Q output as determined by timing capacitor and resistor 440 and 442, respectively. The Q output from one shot 438 is coupled through two voltage dropping diodes 444 to the input of operational amplifier 414 through resistor 426. The output from one-shot 438 is clamped at the voltage of VVP less the voltage drop through diodes 444 by the action of a third diode 446 connected to the output of operational amplifier 412. The output current from one-shot 438 through resistor 426 will almost balance the negative current from the VVN signal applied through resistor 424.

The output from operational amplifier 414 is also applied to the non-inverting input of a comparator operational amplifier 448. The output of comparator 448, which is the same polarity as the input, is connected through a resistor 450 and a diode 452 to the input of operational amplifier 414 through resistor 428. Comparator 448 is provided with a hysteresis as a result of feedback resistor 454 and input resistor 456 connected together as a voltage divider.

The output from operational amplifier 414 is also connected to two voltage divider networks comprised, respectively, of resistors 458 and 459 and resistors 460 and 461. The output from the voltage divider network formed by resistors 458 and 459 is a signal denoted VMODIN. The VMODIN signal is coupled to noise generator 172 to be modulated thereby when voiced consonants are being formed. This is described in greater detail hereinbelow with reference to FIG. 9. The output from the voltage dividing network comprised of resistors 460 and 461 is connected into the signal input of first formant filter 166. The voltage of the signal input to formant filter 166 is approximately 1/100th of the output of operational amplifier 414. Formant filter 166 is comprised of operational amplifiers 462, 463 and 464. The operation of formant filter 166 and the connection of its elements are essentially the same as mentioned above with respect to the modification of FIG. *7a*. The gain of formant filter 166 is highest when the joy stick handle is positioned farthest to the left, causing potentiometer 402 to have a minimum resistance. The center frequency of formant filter 166 is selected so as to be higher than the center frequency of formant filter 168. As mentioned above, the simple parallel combination of a capacitor 465 and resistor 466 in the feedback of operational amplifier 464 results in a slightly narrower bandwidth.

The output from formant filter 166 is connected to the input of a fixed filter 202 that includes an operational amplifier 468 connected as a non-inverting follower having a gain and a bridged "T" filter in its feedback path. The nominal gain is determined by the ratio of the resistances of feedback resistor 470 and resistor 472 connected between ground and the feedback input to the inverting input of operational amplifier 468. The bridged "T" filter is comprised of capacitors 473 and 474 and a resistor 475 connected therebetween in parallel combination with resistors 479 and 480 and capacitors 481 and 478'. Because the bridged "T" filter components are not selected for a true null balance at a given frequency, and resistor 470 shunts the "T" filter, the bandwidth provided by fixed filter 202 is quite broad. The values of the components of fixed filter 202 are selected based on the output of a satisfying sound and can be varied to produce a different sound.

As mentioned above, "m" switch 408 and "n" switch 410 are connected so as to affect the filtering of fixed filter 202. The "m" switch 408 is also connected around operational amplifier 463 in combination with output resistor 476 and the shunted pair of a resistor 477 and a capacitor 478. On the other hand, "n" switch 410 is connected to shunt the output from operational amplifier 463 and resistor 476 to ground through capacitor 478'. This has the effect of attenuating the higher frequencies being fed into operational amplifier 468. Also connected into the feedback path of operational amplifier 468, and effective upon the operation of "n" switch 410, is a further filter comprised of resistors 479 and 480 and a capacitor 481 connected between the two resistors and between the output of "n" switch 410 and capacitor 478'. Consequently, a slight amount of regeneration is provided by the capacitor divider formed from capacitors 478' and 481 back into the non-inverting input of amplifier 468. This causes an increased nasal tone due to the selective frequency amplification under positive feedback.

The output from fixed filter 202 is sent both to mixer 170 and to the input of second formant filter 168 through resistors 482 and 483. Filter 168 is identical to the filter depicted in FIG. *7a* and described above. A capacitor 484 connected between ground and the junction of resistors 482 and 483 provides a 6 dB per octave roll-off to frequencies above 2,000 Hz to attenuate noise and other frequencies too high for the formant filter 168. A CMOS gate 485 is connected in parallel with capacitor 484 between ground and the junction of resistors 482 and 483. CMOS gate 485 is operated by a signal VSTOP to shunt the input signal to formant filter 168 to ground when VSTOP signal is nonzero. This condition occurs during voiced consonants. Thus, CMOS gate 485 is equivalent to switch 174 depicted in FIGS. 5 and 6.

The outputs from filters 166 and 168, from a consonant filter 176 (described below with respect to FIG. 9), and from fixed filter 202 are coupled to mixer 170 through corresponding resistors 486 through 489, respectively. An operational amplifier 490 having a feedback comprised of a resistor 491 and a capacitor 492 connected in parallel sums the inputs and provides an output to a conventional, power operational amplifier 493, which in turn, drives a speaker 494. A capacitor 495, connected between the output from first formant filter 166 and input resistor 486 to mixer 170, is shunted to ground and provides noise suppression and a 47 kHz break point. The feedback combination of resistor 491 and capacitor 492 provides a 6 db per octave attenuation for frequencies above 15.9 kHz.

The remainder of the synthesizer electronic circuit is depicted in FIG. 9. This circuit senses whether any one of consonant keys 28 through 38 have been operated and also generates the signal CONSONANT, which is connected directly to mixer 170 as mentioned above. This circuit also provides two output signals, $\overline{\text{VOICE}}$ and VSTOP, both used to mute some or all of the voicing waveforms generated in FIG. 8. The circuit in FIG. 9 receives as an input, the signal VMODIN, which is noise modulated to form voiced fricatives and plosives. With the exception of the power supplied to the four operational amplifiers in the circuit of FIG. 9, all of the power supplied is +5 volts DC.

Keys 28 through 38 can be conventional switches, or can be comprised of metallic areas formed on an insulating substrate of a printed circuit board. Depression of the appropriate key provides contact between a corresponding membrane, denoted 502 and 504 in FIG. 9 and the metallic area. Membranes 502 are connected together and supply the generated signal PL through the corresponding key and through a corresponding debounce circuit. Membranes 504 are connected together and to ground and supply this input through the appropriately depressed key and through a debounce circuit. As mentioned above, keys 28 through 32 are double-acting keys. A further membrane 506, located on each key for electrical contact with membrane 502 when the right side of the key is depressed, is electrically connected through a further debounce circuit to generate the signal VF. However, membrane 506 is left floating when the left side of the key (for unvoiced fricatives) is depressed. Thus, depression of the right side of keys 28 through 32 generates two signals whereas the depression of the left side thereof generates only a single signal.

The debounce circuits are formed by two CMOS inverting amplifiers connected in series, two resistors connected in series between plus voltage and the contact pad of the corresponding key, and a capacitor connected between the output of the second inverting amplifier and the junction between the two resistors. Positive feedback occurs when the corresponding key is depressed and partially grounded. The output of the second inverting amplifier snaps from its plus voltage to ground, driving the resistor tie point downward through the capacitor. This removes the ability of the contact pad to become positive again and thereby cancels any possibility of a bounce. When the resistor tie point has stabilized at about half the positive voltage and the key is released, the second amplifier output flips from zero voltage to the positive voltage, tending to make the amplifier input become positive rapidly, thereby assuring a clean transition. The first amplifier will then go to zero, signifying an open switch. The two resistors have a value of 1 megohm and the capacitor has a value of 0.1 microfarads.

The outputs from all of the debounce circuits corresponding to keys 28 through 32 are all ORed together in an OR gate 508 and are individually connected to two corresponding CMOS switches in resistor banks 510 and 511. The outputs from the corresponding debounce circuits to keys 33 through 38 are all ORed together in an OR gate 512 and are individually connected to the input of a corresponding monostable multivibrator or one-shot 513 through 518. The output from OR gate 512 is connected through an OR gate 520 to membranes 502 of fricative consonant keys 28 through 32. This applies a high voltage to those pads and prevents any signal from being generated thereby. This is necessary because many consonant sounds in the English language are double, such as the "ch" in the word cheese, or the "j" in the word judge, which are actually formed by the t∫ and d3. It would be difficult to time the finger movements of an operator if the second consonant sound were not interrupted by the first. When membrane 502 is not high, OR gate 520 provides a ground signal thereto, which can then be conveyed through an appropriately depressed key to generate a high signal in the corresponding debounce circuit.

The duration of the pulse produced by one-shots 513 through 518 for the consonant corresponding to keys 33 through 38 is individually set through a corresponding capacitor and resistor. The duration of each one-shot will depend upon the particular, corresponding consonant and can be individually set for maximum intelligibility. In general, consonants "t", "k", and "p" have longer times (on the order of 100 milliseconds) than do the consonants "d", "g", and "b" which are on the order of 40 milliseconds). Exemplary values of the capacitors for each of one-shots 513 through 518 are one microfarad and exemplary values for the resistors of one-shots 513 through 515 are 330 kiloohms and for one-shots 516 through 518 are 150 kiloohms.

The output from one-shots 513 through 518 are ORed through an OR gate 522. In addition, pairs of one-shots 513 and 516, 514 and 517, and 515 and 518, also have their Q outputs ORed together in OR gates 524, 525, and 526, respectively. The outputs from these OR gates are connected to corresponding CMOS switches in resistor banks 510 and 511. The output from OR gate 522 is connected to the N input of a one-shot 528 and to membranes 502 through OR gate 520. The output from OR gate 522 is also connected to one input of another OR gate 530, the other input of which is provided by the output from OR gate 508. The output from OR gate 530 is inverted and connected to the inhibit pin of a conventional, complex sound generator 532, such as integrated circuit SN76477.

One-shot 528 is connected to one input of an OR gate 534, the other input of which is provided by the output of OR gate 520. The output from OR gate 534 is ORed in an OR gate 536 with the output from OR gate 508 and provides the signal VSTOP used to inhibit the production of vowel sounds as discussed above with respect to FIG. 8. One-shot 528 has its associated capacitor and resistor selected so as to provide an additional silence of about 25 milliseconds. This can be accomplished with a capacitor having 0.33 microfarads and a resistor having 220 kiloohms. Thus, vowel sounds are inhibited (VSTOP high) during the time: (1) any plosive key is depressed (PKEY high); (2) any unvoiced timer is active (PUVT high); (3) any voiced timer is active (PVT high); or (4) one-shot timer 528 is active. The signal leaving OR gate 534 is called PSTOP and the signal leaving OR gate 508 is called FR. While any voiced timer is active (i.e, PVT is high), the $\overline{\text{MOD}}$ signal is low, allowing an AND gate 538, which is also connected at one input to the output of OR gate 536, to remove the inhibit on the VOICE signal line, and enabling a modulator 540 that is comprised of a transistor 542 and an OR gate 543. The other input to OR gate 543, which is the modulated signal, is the NOISE output from sound generator 532.

As mentioned above, modulator 540 is enabled and AND gate 538 is disabled whenever $\overline{\text{MOD}}$ signal is low. This occurs whenever one of the inputs to an OR gate 545 is high, the output being inverted by an inverted 546. OR gate 545 is active whenever signal VF is produced (i.e. whenever the right side of keys 29 through 32 are depressed), or whenever there is an output from one-shots 516, 517 or 518 (i.e. following the depression of one of keys 36, 37 or 38). In addition, $\overline{\text{MOD}}$ signal opens CMOS switch 548. This results in an interruption of the noise input from sound generator 532 to the input of consonant filter 176. However, noise output from sound generator 532 can now drive modulator 540 (since OR gate 543 is unclamped) to alternately clamp and unclamp the voltage VMODIN to ground, thereby modulating this signal and sending the modulated signal to consonant filter 176 instead of the unmodulated signal.

Sound generator 532 has a noise source clock rate that is controlled by the amount of current through pin 4. This current is determined by resistor 550 of resistor bank 510 in parallel combination with any other one of the selected resistors. Except for resistor 550, each of the resistors of resistor bank 510 is tied parallel with resistor 550 by a CMOS switch. As mentioned above, these switches are controlled by the outputs from the various debounce circuits. Resistor bank 510 is located between the output of operational amplifier 552 connected as a follower amplifier and the clock input of sound generator 532. The output signal of follower amplifier 552 is slightly positive whenever VVN is 0 (i.e. no operation of pitch/inflection control key 40). The output of follower amp 552 goes negative as signal VVN goes negative and this results in some pitch control of the consonant sound. Suggestive resistances in kiloohms of the resistors in resistor bank 510, beginning with unswitched resistor 550 are as follows: 330; 10; 39; 150; 82; 120; 47; and 27.

Figure 7A:
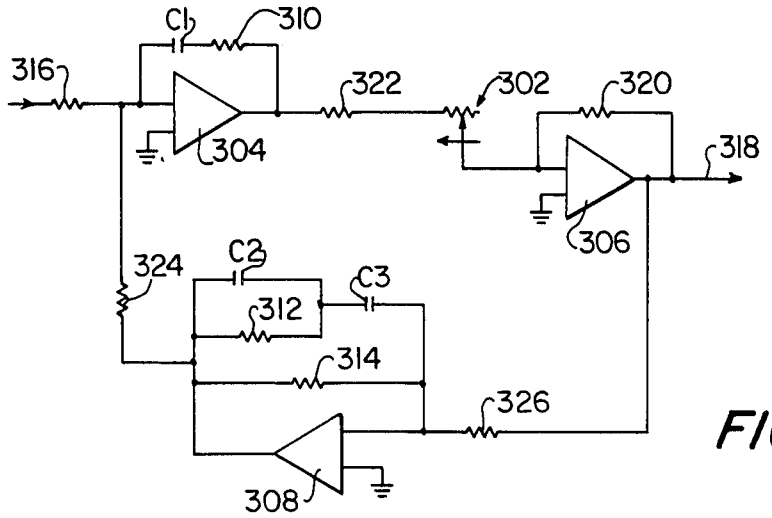
FIGS. 7*a*, 7*b*, and 7*c* are electrical schematic diagrams depicting three embodiments of a controllable formant filter.
Figure 7B:
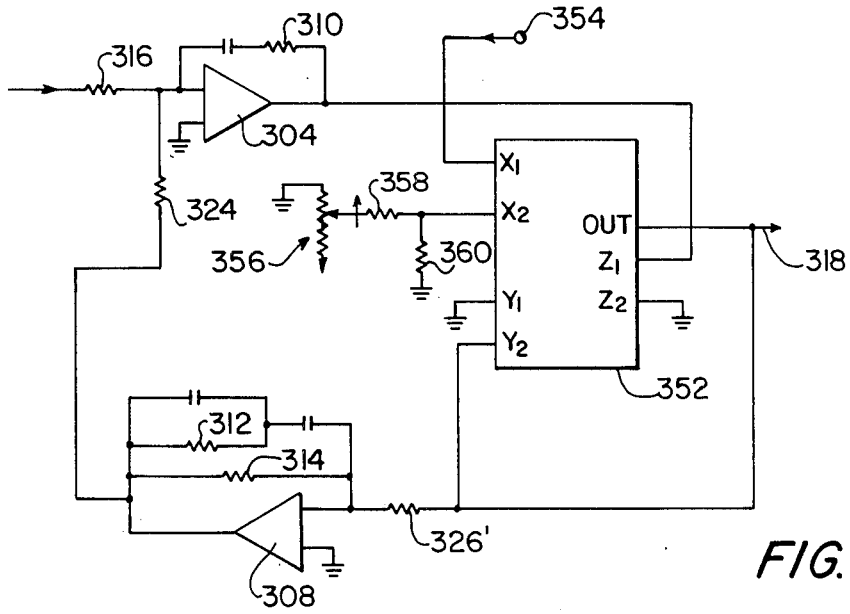
Figure 7C:
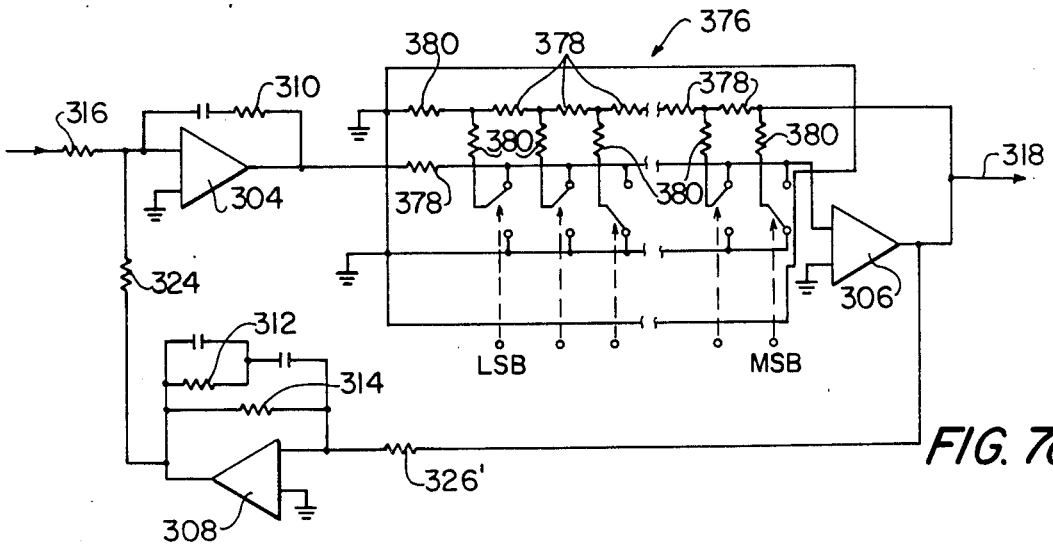

As mentioned above, the signals that switch the resistors in resistor bank 510 simultaneously switch the resistors in resistor bank 511. These resistors are connected in the input to the inverting operational amplifier of consonant filter 176 (denoted 306 because of the similarity to the filters described herein above with respect to FIG. 7). The amount of resistance switched into consonant filter 176 sets the gain of the inverting operational amplifier resulting in a high gain for a high formant frequency. Suggestive resistances in kiloohms for the resistors of resistor bank 511, beginning with the resistor on the left side as seen in FIG. 9 are as follows: 47; 150; 82; 120; 220; 39; and 100.

The operation of the synthesizer as depicted in FIGS. 8 and 9 is as follows. Depression of pitch/inflection switch 406 smoothly generates negative voicing voltage VVN which flows through resistors 423 and 424 in parallel into the inputs to operational amplifiers 412 and 414. The flow of negative current into operational amplifier 414 sets the slope of the positive ramp of the voicing signal voltage which is generated at the output thereof. The more negative VVN is, the steeper is the slope of the voicing signal voltage (sometimes called the glottal pulse) at the output of operational amplifier 414. This results in a more rapid rate of change in the frequency or pitch of the voicing signal. When the consonant circuits are active, a 5 volt level called $\overline{\text{VOICE}}$ is applied to resistor 430 tending to stop all oscillations. Diode 422 conducts at this time.

Assuming that one-shot 434 has just turned off (i.e. the Q output is 0), the output of operational amplifier 414 will begin to rise from its diode-clamped slight negative output voltage of −0.6 volts. For a 10,000 ohm value for pitch/inflection switch 406, the voltage out of operational amplifier 414 will climb 3.8 volts in 1.7 milliseconds. At this point, there will be a sufficient input to trigger one-shot 438 to provide a 0.3 millisecond pulse at the Q output. The current out of one-shot 438 flows through an output resistor into diode 446, which will allow the voltage at the top of a clamping resistor at the output of diodes 444 to go no higher than voltage of the VVP signal (actually slightly lower than VVP voltage because of the voltage drop of diodes 444). The input positive current to operational amplifier 414 through resistor 426 will almost balance the negative current coming through resistor 424 from the VVN signal. This produces a momentary halt or plateau in the voltage wave form out of operational amplifier 414 for 0.3 millisecond, until one-shot 438 times out. Then the voltage continues to climb at the same slope for another 1.7 milliseconds until the voltage reaches 8.0 volts to trigger comparator 448. The plateau in the wave form contributes a slight rasp or faint rattle to the voicing wave form and thereby contributes to its naturalness. The output of comparator 448 goes positive and by means of the current flowing through resistor 450 clamps the voltage at the output of diode 452 to the VVP voltage. This results in a positive current flowing into operational amplifier 414 that is more than five times greater than the current flowing through resistor 424 as a result of resistor 428 being approximately 1/5 the resistance of resistor 424. The algebraic difference of 4 times the positive current resets the output voltage of operational amplifier 414 to zero in a very short time (about 1 millisecond). Comparator 448 also resets (goes very negative toward −15 volts) as the output voltage of operational amplifier 414 goes to zero. This provides a negative trigger to one-shot 434, the negative voltage being limited by the series resistor and parallel diode combination in the input to one-shot 434. One-shot 434 then provides a fixed voltage pulse for 1.9 milliseconds to resistor 432 at the input of operational amplifier 414 to hold it at zero volts (actually −0.6 volts because of the series diode). This corresponds to a fixed relaxation period in the vocal cord oscillation. All other times in the wave form, except for the 0.3 millisecond delay, will shorten proportionally to increased current as the resistance provided by pitch/inflection switch 406 decreases (i.e. switch 406 is pressed harder). The total time of the oscillation cycle when switch 406 provides a resistance of 10,000 ohms is 6.6 milliseconds (1.7+ 0.3+ 1.7+ 1.0+ 1.9), which represents about 150 Hertz.

When "m" switch 408 is closed, the resistance therefrom causes a different feedback path to be formed around operational amplifier 463 of first formant filter 166. This reduces the amount of signal going to operational amplifier 468 of fixed filter 202, especially at the higher frequencies. When "n" switch 410 is closed, resistor 477 and capacitor 478 have no effect, but the high frequencies going into operational amplifier 468 are attenuated by the filtering action of resistor 476 and capacitor 478'. As mentioned above, the output of amplifier 468 provides the signal input to formant filter 168. Capacitor 484, located at their junction, attenuates noise and other frequencies too high for filter 168.

Consonants are produced by the operation of the selected one of keys 28 through 38. Assume that a voice fricative such as a "v" or "z" is desired and no plosive keys (keys 33 through 38) are depressed; thus, the voltage on membrane 502 is zero as a result of the output from OR gate 520 being zero. When the right side of key 32 is depressed, a high signal voltage (i.e +5 volts) will be produced on lines 554 and 556 from the output of the debounce circuits associated with key 32 and membrane 502, respectively. This causes a signal FR coming out of OR gate 508 to have a high voltage. This signal is inverted and applied to pin 9 of sound generator 532, thereby removing the previously applied inhibit signal. A high FR signal also produces a high VSTOP signal coming out of OR gate 536.

The voiced fricative signal VF on line 556 becomes inverted by inverter 546 and opens CMOS switch 548. As mentioned above, this prevents the noise signal produced by sound generator 532 from affecting formant filter 176.

With line 554 going high as a result of the right side of switch 32 being depressed, the corresponding CMOS switches in resistor banks 510 and 511 are closed. This causes the resistance applied to sound generator 532 by resistor bank 510 to be the resistance of the parallel combination of resistor 550 and 82 kiloohms. Closing the appropriate CMOS switch of resistor bank 511 sets the gain of amplifier 306 in consonant formant filter 176 by placing the 220 kiloohm resistor in parallel with resistor 320, resulting in a high gain for a high formant frequency.

The attack or rate of rise in the amplitude of the noise output from pin 13 of sound generator 532 is determined by the combination of a capacitor 558 at pin 8 of sound generator 532 and resistor 560 applied at pin 10 of sound generator 532. A second resistor 562 in parallel with resistor 560 is not applied at pin 10 because of switching transistor 564 being turned off as a result of a zero output from OR gate 520. However, when a plosive consonant switch is depressed (i.e. one of switches 33 through 38), the output from OR gate 520 will be high and transistor switch 564 will be turned on placing resistor 562 in parallel with resistor 560. Because resistor 562 has a much lower resistance, the effect of the two parallel resistors will effectively be that of only the resistance of resistor 562. This results in a very rapid rise time for plosive consonants.

The generation of the fricative consonant "s" is similar to that generated for consonant "z". Line 554 still goes high, but now line 556 and thus VF signal is low. Line 556 being low causes $\overline{\text{MOD}}$ to be high. With two high inputs into AND gate 538, the $\overline{\text{VOICE}}$ will be high. In addition, VSTOP will also be high, and the net result is that the voicing signal will be terminated as long as the left side of switch 32 is depressed. The noise clock frequency for sound generator 532 and the frequency selected of consonant formant filter 176 will be the same as mentioned above for the application of the consonant "z". Furthermore, the modulator 540 will be held conducting or inactive as a result of the constant application of a high voltage at one of the inputs to OR gate 543. This has the effect of inhibiting any signal input from sound generator 532 to the other input of OR gate 543. A high $\overline{\text{MOD}}$ signal also closes CMOS switch 548, thereby providing the white noise from pin 13 of sound generator 532 to consonant filter 176. This results in the "s" sound being produced.

Those plosive consonants having similar sound are paired by OR gates 524, 525 and 526. These pairs are "t" and "d", "k" and "g", and "p" and "b". The resulting outputs from the particular OR gate switches in the corresponding noise clock resistor of resistor bank 510 and sets the gain of consonant formant filter 176 by switching in the appropriate gain resistors of resistor bank 511. Plosive consonants "t" and "d" have the highest formant frequency. Thus, the operation of keys 33 or 36 does not switch any resistor of resistor bank 511 into the circuit, and the gain of amplifier 306 is determined only by resistor 320. As mentioned above, the depression of any corresponding plosive consonant key causes membrane 502 to have a high voltage, thereby overriding any fricative consonant.

The plosive sounds are generated following the release of the key. During the key closure, an initial silence results, the duration of which is determined by the operator. When the key is released, the corresponding switch signal goes low and the trigger input to the corresponding one-shots 513 through 518 is energized. This results in the Q output of that one-shot to go high for the predetermined, fixed time delay. By combining the Q outputs of one-shots 513 through 518 in OR gate 522, a timed signal is produced at the output of OR gate 522 whenever one of the plosive keys is operated. It is during this time that the consonant sound is produced. The negative transition when the particular one-shot times out triggers one-shot 528. As mentioned above, this inserts a short silent period following the plosive burst.

Figure 10:
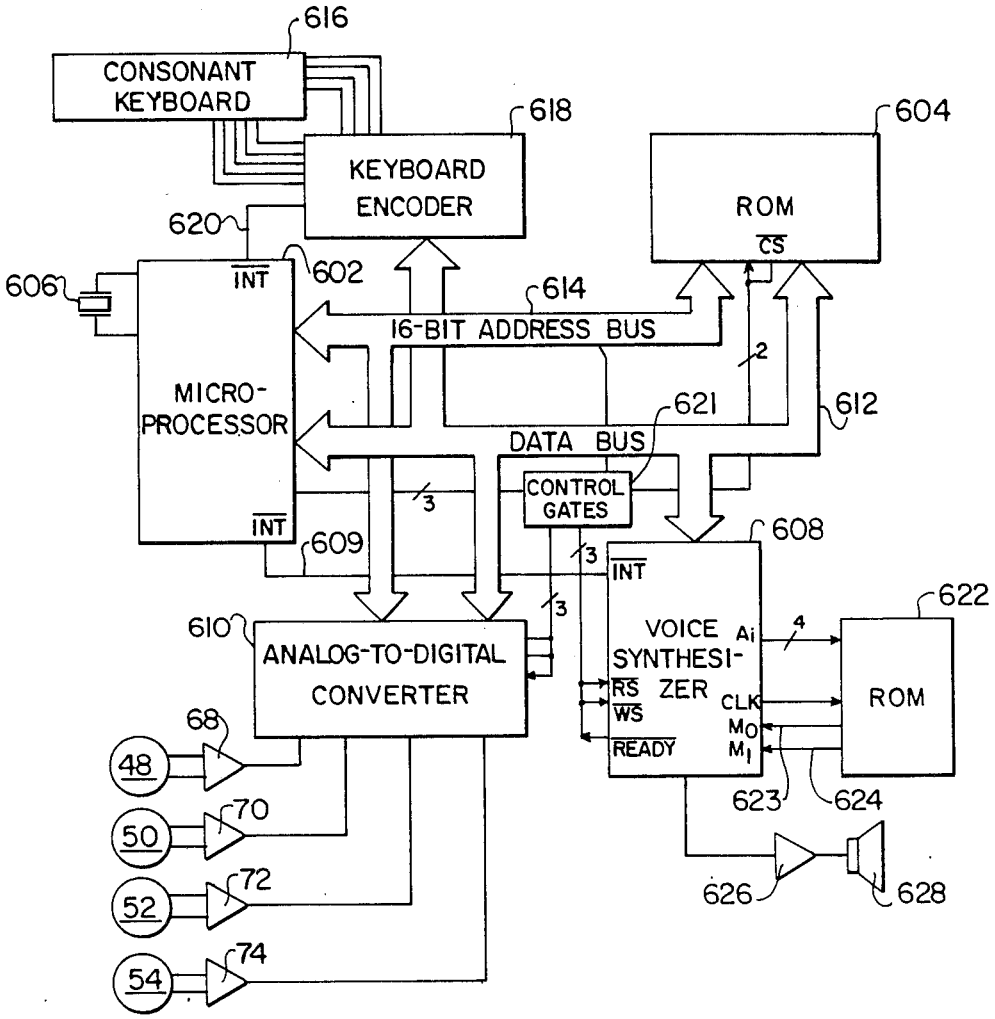
FIG. 10 is an electrical schematic block diagram of a further embodiment of a synthesizer utilizing a microprocessor and a digital voice synthesizer.

With reference now to FIG. 10, a microcomputer controlled speech synthesizer is depicted. The microcomputer includes a microprocessor 602 and a ROM (read-only memory) 604. Microprocessor 602 is preferably one that has a very fast cycle time, such as the 16-bit microprocessor TMS 9995 manufactured by Texas Instrument. The clock of microprocessor 602 is determined by a crystal 606 and preferably is between 3.12 MHz to 11 MHz. ROM 604 is preferably an 8K by 8-bit read only memory that has an access time that is compatible with the clock of microprocessor 602.

The TMS 9995 microprocessor has the advantages of including an integral 256 by 8 bit RAM and a 16 bit timer for real time operations. In addition, this microprocessor has very fast multiplication and division capabilities with digital numbers. In addition, this microprocessor interfaces well with a voice synthesizer integrated circuit 608 manufactured by the same company (TMS 5220), the microprocessor needing only about 2% to 4% of its time to service voice synthesizer 608.

The main computer program stored in ROM 604 commands microprocessor 602 to determine the resolution and pitch/inflection force from playing board 42' (FIG. 2). This input is represented by transducers 48, 50, 52 and 54 coupled to amplifier 68, 70, 72 and 74, respectively. The outputs from amplifier 68, 70, 72 and 74 are fed to the inputs of a multiplexing analog-to-digital (A-D) converter 610. Such a converter can be of the type AD 7581 manufactured by Analog Devices.

A-D converter 610 continuously scans the inputs at a high speed and stores the most recent data values in its own 8 byte by 8 word RAM in synchronism with the microprocessor clock. Thus, microprocessor 602 can access the information in converter 610 simply by performing a memory fetch operation. The main computer program uses the data stored in converter 610 to calculate the coordinates of the playing surface positions and then determine the appropriate formant frequencies and band widths required for producing the desired vowel sound. Alternatively, a look-up table can be used. Microprocessor 602 also translates the calculated or determined formant frequencies and band widths into reflection coefficients for voice synthesizer 608. For a TMS 5220 speech synthesizer, this means translating the formant frequencies and bandwidths into reflection coefficients for the 10-pole Linear Predictive Coding speech synthesis. The on-board RAM of microprocessor 602 can be used to store both the reflection coefficients and the pitch/inflection information for appropriate transfer to voice synthesizer 608.

Voice synthesizer 608 signals microprocessor 602 for more data over an interrupt line 609. This can occur approximately every 40 milliseconds for a TMS 5220. The computer program in ROM 604 includes a conventional interrupt service routine for transferring this information to speech synthesizer. For this purpose, an 8-bit data bus 612 and a 16-bit address bus 614 interconnect microprocessor 602, ROM 604, and converter 610. In addition, data bus 612 is connected to voice synthesizer 608.

The consonant keys 26 through 38 of FIG. 1 and 2 are schematically indicated on a keyboard 616. Consonant keyboard 616 is connected to data bus 612 through a keyboard encoder 618. An appropriate encoder 618 is the type AY 5-2376 manufactured by General Instrument. A "key down" output from keyboard encoder 618 is connected to microprocessor 602 through a second interrupt line 620. The computer program stored in ROM 604 also has an interrupt service routine initiated by a signal on interrupt line 620. Preferably, this service routine also deselects any other device which may have been connected to data bus 612. This is accomplished through control gates 621, which provide Chip Select, Read Select, or Write Select signals to the inputs of the other devices.

The data sent to data bus 612 by keyboard encoder 618 is used by microprocessor 602 to determine which consonent key was depressed. Microprocessor 602 uses a lookup table in ROM 604 to determine a starting memory address based on which key was depressed. This starting address is transmitted to speech synthesizer 608 over data bus 612. Working in tandem with voice synthesizer 608 is a speech memory ROM 622 such as a TMS 6100 manufactured by Texas Instruments. The address delivered to speech synthesizer is in turn delivered to ROM 622 over 4 address lines in a five data transfer sequence. The reflection coefficients and other amplitude parameters are then loaded into voice synthesizer 608 from ROM 622 over bi-directional address lines A; under the control of signals on $M_0M_1$ lines 623 and 624, respectively. When the allophone corresponding to the depressed consonent key is completed, a stop command is provided causing a $\overline{\text{READY}}$ output from voice synthesizer 608 to go low. This signal is transmitted by control gates 621 to microprocessor 602. Thereupon the microprocessor will be commanded by the computer program to resume loading the current vowel formants directly into voice synthesizer 608. Alternatively, when there is no pitch/inflection input, a stop command can be loaded into speech synthesizer 608 to cause it to wait in silence for the next input. Voice synthesizer 608 directly generates appropriate speech wave forms and provides them to its output, to which is connected an audio amplifier 626 and a speaker 628.

In an alternative embodiment, keyboard encoder 618 can be eliminated by dividing the consonent keys into four groups of four to five keys in each group and to assign a different voltage to each key within a group. Signal wires from each group can then be connected to an analog-to-digital converter of the type used for converter 610. As microprocessor 602 detects a non-zero input on one of these channels, it reacts as if an interrupt had been received. The identification of the key that was pushed is made by inspecting the magnitude of the voltage bits stored by the converter.

Other variations are possible in a digital speech synthesizer. For example, other voltage inputs can be supplied to the multiplexing analog-to-digital converter inputs. These could include the coordinate and pitch-/inflection voltages discussed above with respect to FIG. 3, or the coordinate signals of a keyboard input, discussed below with respect to FIG. 11. The pitch/inflection voltages could be set by a voltage such as VVN (FIG. 8). By utilizing multiplying digital-to-analog converters and successive approximation registers in the circuit depicted in FIG. 3 to replace a pair of analog multiplier/dividers, the coordinate positions may be directly obtained in a digitized form. Obviously, other microprocessors and other speech synthesizers can be used with appropriate changes in the circuit.

Figure 11:
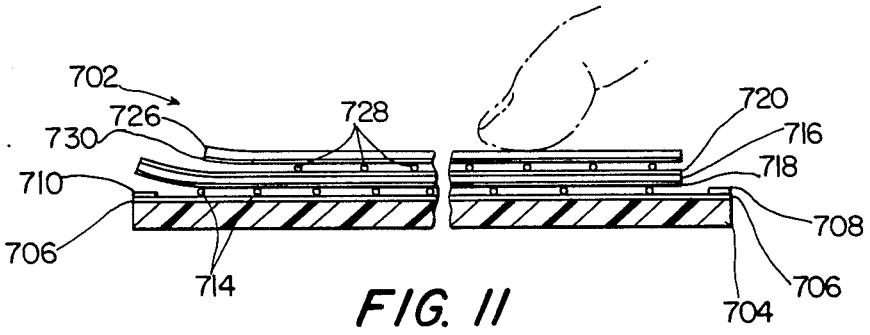
FIG. 11 is a cross-sectional view of one embodiment of a two-dimensional position indicating tablet with the dimensions exaggerated for clarity.

With reference now to FIG. 11, a multi-layer device 702 capable of indicating the coordinates of the location being depressed is depicted. Device 702 is comprised of a substrate 704 on which a resistance layer 706 has been deposited. Substrate 704 provides the physical support for device 702. The combined resistances of substrate 704 and resistance layer 706 is preferably in the range of 100 ohms per square centimeter to 50,000 ohms per square centimeter, and preferably is in the center of that range. Mounted along the edges of the two ends of resistance layer 706 are a first conductive strip 708 and a second conductive strip 710. Strips 708 and 710 permit a substantially horizontal electric field to be generated when voltages are applied thereto.

A flexible conducting layer 712 is mounted above resistance layer 706 and spaced therefrom by a plurality of insulator beads 714. Insulator beads 714 permit contact between conductive layer 712 and resistance layer 706 whenever localized pressure is applied on device 702. Insulator beads 714 can be in the form of glass or plastic spheres, or may be paint or varnish droplets applied, for example, by silk-screening or by being sprayed. Conductive layer 712 can be comprised of a sheet 716 preferably of an insulating plastic film of polystyrene, polyethylene terephthalate (known by the trademark "MYLAR"). The underside of sheet 716 has a coating 718 of a conductive material. Sheet 716 must be thin enough so that it can be deflected downwardly when pressure is applied thereon, but be thick enough to resist stretching or any lateral movement. Coating 718 preferably has a resistance that is less than 100 ohms per square centimeter. The topside of sheet 716 has a second coating 720 having approximately the same resistance parameters as resistance layer 706. Mounted along the two transverse edges and extending longitudinally are a third conductive strip 722 and a fourth conductive strip (not shown). A terminal 724 is connected to conductive coating 718.

A top cover sheet 726 is mounted on top of sheet 716 and spaced therefrom by a plurality of beads 728, similar to beads 714. Cover sheet 726 is also preferably of a plastic film such as polyethylene terephthalate ("MYLAR"). A conductive coating 730 is located on the undersurface of cover sheet 726. Conductive coating 730 preferably has a low resistance that is less than 100 ohms per square centimeter. A terminal 732 is connected in electrical contact with coating 730. The upper surface or top surface of cover sheet 726 forms playing surface similar to playing surface 42 of FIGS. 1 and 2. The IPA symbols for the vowel sounds can be embossed or marked thereon. Preferably, however, to prevent the symbols from being removed through use, cover sheet 726 should be transparent and the symbols should be printed on the underside of cover sheet 726 above conductive coating 730.

Figure 12:
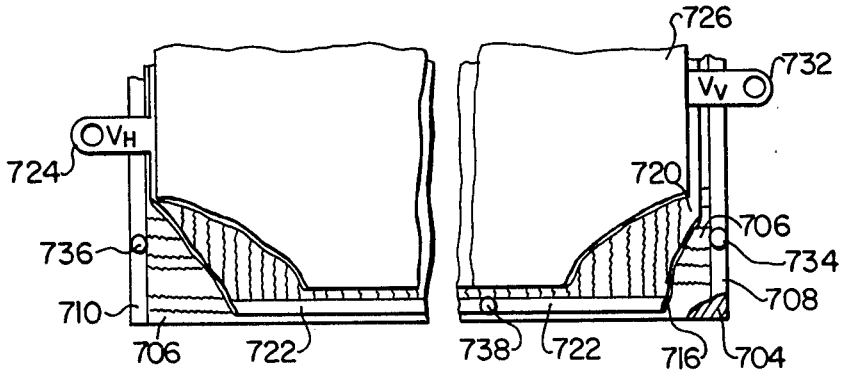
FIG. 12 is a plan view of the tablet of FIG. 11, with parts removed.

Mounted on first conductive strip 708 is a terminal 734 for the application of a suitable positive voltage (e.g. +5 volts or +15 volts). A ground terminal 736 is located on the opposite conductive strip 710 for the connection of a ground potential. Similarly, a positive voltage terminal 738 is located on the bottom or third conductive strip 722 and a corresponding ground terminal (not shown) is connected on the top conducting strip (also not shown). Thus, it should be apparent that when suitable power connections are made to terminals 734, 736, 738 and the fourth, ground terminal, and when pressure is exerted on top of device 702 compressing the various layers, an output voltage will appear on $V_H$ terminal 724 and $V_V$ terminal 732. The output voltages will be proportional to the distance from positive voltage terminals 734 and 738. Thus, the output signal $V_H$ goes from the applied positive voltage to zero volts when pressure is moved from the right to the left as depicted in FIG. 12, and similarly, output signal $V_V$ goes from the applied positive voltage to zero volts when the pressure is moved from the bottom to the top of device 702 as depicted in FIG. 12. When device 702 is used in a synthesizer circuit according to the present invention, it will be the position resolution circuit 160 as depicted in FIGS. 5 and 6 and signals $V_H$ and $V_V$ will be provided at outputs 162 and 164. The lower these voltages will be, the higher the formant frequencies provided by the corresponding formant filter 166 or 168, respectively.

Figure 13:
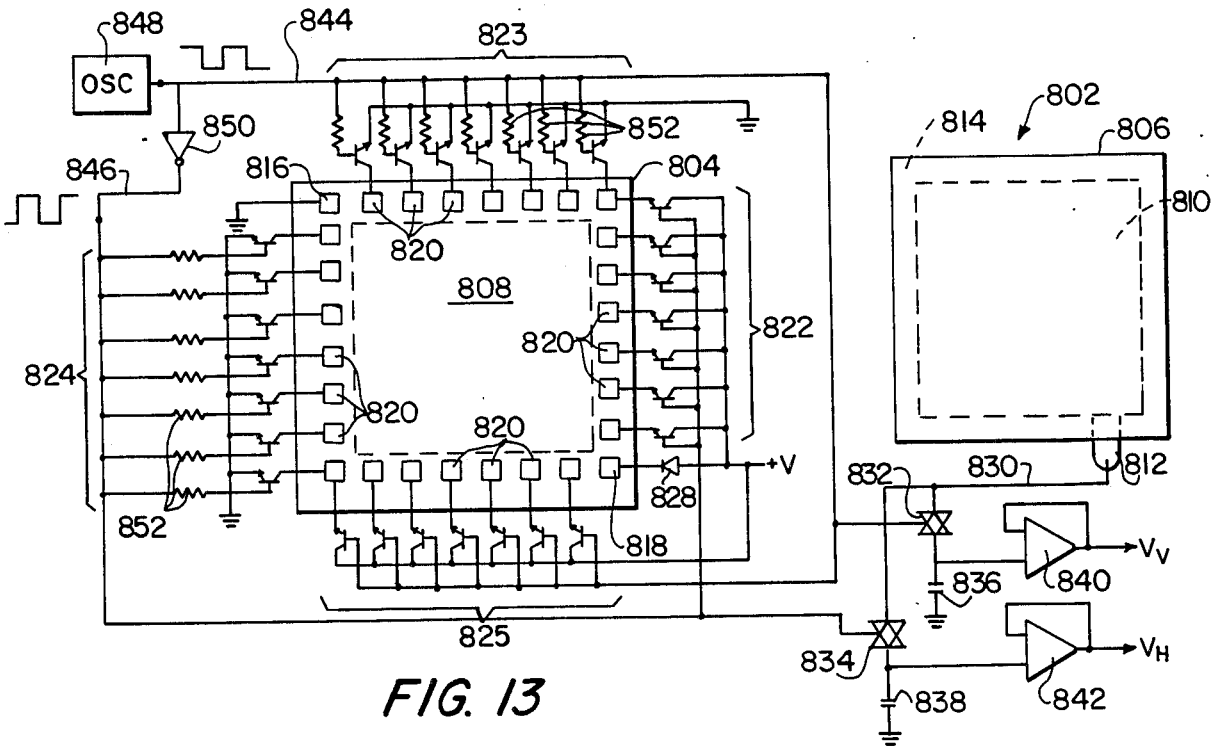
FIG. 13 is an electrical schematic circuit diagram depicting the electrical connections to a tablet of yet another embodiment.

Referring now to FIG. 13, a second embodiment of a specific input board or device 802 is depicted. Device 802 is comprised of a substrate 804 and a cover sheet 806, shown separated from substrate 804. Located on top of substrate 804 is a resistive coating 808. Preferably, the total resistance of both resistive coating 808 and substrate 804 is about 1000 ohms per square centimeter, but a higher or lower order of magnitude of resistance would be acceptable. Deposited on the bottom or underside of cover sheet 806 is a conductive layer 810 preferably having a resistance less than a hundred ohms per square centimeter. A terminal 812 is in electrical contact with conductive layer 810. Cover sheet 806 can be similar to cover sheet 726 and made of a transparent, "MYLAR" (polyethylene terephthalate) on which is printed the IPA phonetic symbols. An annular piece of insulating sheet material 814 is adhered to the underside of cover sheet 806. A plurality of insulating beads (not shown), but similar to beads 714 and 728 in FIGS. 11 and 12, are adhered to the surface of resistive coating 808. In an assembled embodiment of device 802, cover sheet 806 is adhesively mounted or otherwise secured on top of substrate 804 and resistive coating 808, separated from the latter by the insulating beads.

Mounted around the edge of substrate 804 in contact with resistive coating 808 are two power terminal contacts, a ground terminal contact 816 and a positive voltage terminal contact 818. In addition, a large number of signal terminal contacts 820 are located around the periphery of substrate 804 in electrical contact with resistive coating 808. Contacts 816, 818 and 820 can be accurately located and applied onto resistive coating 808 by a number of methods including silk-screening, printing, spraying or painting. Suggestive materials for these contacts are conducting epoxies or a conducting silver paint. The ratio of the width of contacts 816, 818 and 820 to the space between the contacts should be within the range of 1:1 and 1:3. By making the area occupied by contacts 816, 818 and 820 to no more than 25% to 50% of the annular strip in which the contacts are located, minimum distortion of the voltage field will occur at the edges due to the short-circuiting effect of the conductive contacts on resistive coating 808.

Four banks of switching transistors 822, 823, 824 and 825 are electrically connected to the left hand side, the top, the right hand side, and the bottom signal terminal contacts 820, respectively. The transistors in transistor bank 822 and 825 are connected as a common collector transistor array and the transistors of transistor banks 823 and 824 are connected together as a common emitter transistor array. Exemplary transistors of transistor banks 823 and 824 are CA 3081 transistors manufactured by RCA and exemplary transistors for transistor banks 822 and 825 are CA 3082 transistors manufactured by RCA. The collectors of transistor banks 822 and 825 are connected to a positive voltage connection. The emitters of transistor banks 823 and 824 are connected to ground. A diode 828 is connected between the positive voltage and contact 818 so as to provide about the same voltage drop as the transistors in transistor banks 822 and 825. As thus arranged, transistor banks 822 and 824 provide a switchable horizontal (as depicted in FIG. 13) electric field and transistor banks 823 and 825 provide a switchable vertical electric field.

The output from device 802 is taken from terminal 812 by an output line 830. Output line 830, in turn, is connected through two CMOS switches, a vertical CMOS switch 832 and a horizontal CMOS switch 834, to a vertical signal storage capacitor 836 and a horizontal signal storage capacitor 838, respectively. The electrical output from device 802 is provided by two operational amplifiers, a vertical signal operational amplifier 840 and a horizontal signal operational amplifier 842, each connected as a high input impedance follower. The outputs from operational amplifiers 840 and 842 follow the voltage on capacitors 835 and 838, respectively, without drawing much current from them.

The gates of the transistors in transistor banks 823 and 825 and the gate of CMOS switch 832 are all connected together to a common line 844, and the gates of the transistors of transistor banks 822 and 824 and the gate of CMOS switch 834 are all connected together to a common line 846. A low frequency oscillator 848 is directly connected to and provides a scanning waveform to line 844, and is connected to line 846 through an inverter 850, thereby providing a phase shifted scanning waveform to line 846. Oscillator 848 can simply be comprised of two CMOS inverters, two resistors and one capacitor (not shown). Preferably, the scanning waveform is a square wave having a frequency in the range of 100 Hz to 100 kHz frequency. A current limiting base resistor 852 is connected to the base of each of the transistors in transistor banks 823 and 824. Resistors 852 can have an exemplary resistance of 10,000 ohms.

In operation, capacitors 836 and 838 are alternately connected to output line 830 through switches 832 and 834, respectively, operated in sequence by the scanning waveform and the phase shifted scanning waveform applied to lines 844 and 846, respectively. Thus, capacitors 836 and 838 are alternately connected to any voltage applied to conductive layer 810 of device 802. When the individual signal in the phase shifted waveform applied line 846 is high, the transistors of transistor banks 822 and 824 are turned on, causing a horizontal voltage gradient across resistive coating 808. Downward pressure on cover sheet 806 connects output line 830 to a small zone of the resistnace coating 808 directly under the point of pressure. The voltage at the point of pressure is delivered to output line 830. Since CMOS switch 834 is turned on at the same time that the transistors of transistor banks 822 and 824 are turned on, voltage under the point of pressure also appears across capacitor 838 after a relatively small time delay. Consequently, this voltage also appears at the output of operational amplifier 842.

When the horizontal voltage gradient is turned off, a vertical voltage gradient is applied to resistive coating 808 as a result of the operation of the transistors in transistor banks and 823 and 825. The amount of voltage at the point of pressure will appear across capacitor 836 in a fashion similar to the charging of capacitor 838. Capacitors 836 and 838 hold the voltage during the time that their respective CMOS switch is open. In this manner, an analog voltage signal representative of the horizontal location of the pressure point and representative of the vertical location of the pressure point will respectively appear as output signals $V_H$ and $V_V$ at the outputs of operatiohal amplifiers 842 and 840.

Device 802 provides an input terminal having good linearity up to the edges of the inner playing space defined by signal contacts 820. It also provides mechanical simplicity and a one contact point between a resistive coating and a conductive film instead of the two contact points of device 702 in FIGS. 11 and 12. Consequently, device 802 of FIG. 13 has a relatively low manufacturing cost and a high degree of reliability.

Thus, there is disclosed herein a speech synthesizer that can be "played" live and will form natural sounding words according to the motions of the hands of the operator. Such a device can be used as a prosthesis for those persons who have lost their voices or who have a speaking impairment. In one embodiment, the speech synthesizer is "played" on a two-dimensional surface over which the fingers of the operator range to sound any of the vowels, dipthongs, or semi-vowels together with a selection area where fricative or plosive consonants can be individually selected. A further feature operable separately or derived from the total pressure applied to the playing surface adds a control of the pitch and/or inflection of the voicing source. The formation of the sounds can be done using either an analog synthesizer or a digital synthesizer.

The present invention can also be used for applications other than as a prosthesis. For example, it can be used to teach the principles of formation of human speech. The present synthesizer never runs out of breath and can sustain a tone continuously. The exciting waveform can be listened to and displayed on an oscilloscope and observed as various vowels are sounded. A second synthesizer can be connected to a frequency spectrum analyzer to show what is happening to the amplitude response versus frequency as various vowel sounds are produced on the first.

Another educational and research application of the present invention is in the field of linguistics to match the vowel and dipthong sounds of regional speech. For example, the present invention can say "you all" with a Southern drawl that is quite convincing. Once determined, the various sounds can be cataloged by reference to the horizontal and vertical coordinates.

A digital embodiment of the present invention can be used to produce a stream of digital bits to some form of digital memory. In this manner, the speaking vocabulary for a digital synthesizer can be expanded to create words not only in the English language but in any language. This would be a very economical way of producing custom encoding of words.

The baud rate of the present invention is relatively low, on the order of six hundred bits per second. In the analog embodiment of the present invention there are three signal parameters which change only slowly with time. These signals may be multiplexed and transmitted using conventional techniques over limited bandwidth facilities, or they may be digitized with an analog-to-digital converter. If saved in a digital form, a smaller amount of memory space is needed compared to the space required for Linear Predictive Coding.

The touch-sensitive tablet of the present invention can also be used as a control for video games or as a tracing tablet for providing graphs, maps and handwriting information to a computer.

While the present invention has been described with respect to specific embodiments thereof having specifically enumerated advantages and objectives, it should be obvious to those skilled in the art that alternative embodiments and alternative objectives are possible using the teachings disclosed hereinabove.

TABLE 1

| Resistors (ohms) | Capacitors (microfarad) |
|---|---|
| R302 - 100k (potentiometer) | C1 - .001 |
| R310 - 22k | C2 - .66 |
| R312 - 2.7k | C3 - .33 |
| R314 - 22k | C416 - 6.8 |
| R316 - 100k | C420 - .039 |
| R320 - 47k | C440 - .0047 |
| R322 - 1.8k | C465 - .047 |
| R324 - 100k | C473 - .01 |
| R326 - 10k | C474 - .01 |
| R326' - 22k | 478' - .047 |
| R358 - 10k | C478 - .047 |
| R360 - 1k | C481 - .047 |
| R378 - 10k | C484 - .001 |
| R380 - 20k | C492 - .001 |
| R402 - 100k (potentiometer) | C558 - .33 |
| R404 - 100k (potentiometer) | C836 - .1 |
| R418 - 120k | C838 - .1 |
| R423 - 15k | C495 - .0047 |
| R424 - 100k | |
| R426 - 100k | |
| R428 - 18k | |
| R430 - 5.6k | |
| R432 - 22k | |
| R450 - 5.6k | |
| R454 - 33k | |
| R456 - 10k | |
| R458 - 75k | |
| R459 - 22k | |
| R460 - 100k | |
| R461 - 1k | |
| R466 - 22k | |
| R470 - 68k | |
| R472 - 27k | |
| R475 - 22k | |
| R476 - 22k | |
| R477 - 18k | |
| R479 - 47k | |
| R480 - 47k | |
| R482 - 330k | |
| R483 - 100k | |
| R486 - 8.2k | |
| R487 - 33k | |
| R488 - 330k | |
| R489 - 82k | |
| R491 - 10k | |
| R550 - 330k | |
| R560 - 330k | |
| R562 - 22k | |
| R320' - 470k | |
| R436 - 15k | |
| R437 - 39k | |
| R442 - 100k | |

TABLE 1-continued

| Resistors (ohms) | Capacitors (microfarad) |
|---|---|
| R852 - 10k | |

TABLE 2

| I.C. Number | |
|---|---|
| 4528 | One shots 434, 438 |
| 741 | Operational amplifiers 412, 414, 448, 462, 463, 464, 468, 490 |
| 4066 | CMOS gates 485, 548 |

It is claimed:

1. A speech sound generating system comprising:

means for simulating the frequency response of the vocal tract, said frequency response including two or more resonant peaks or formants continuously movable in frequency, said means for simulating the frequency response of the vocal tract comprising a tunable formant filter for each of said formants;

means continuously responsive to operator input for simultaneously and continuously controlling the frequency locations of each of said formants by continuously tuning said tunable formant filters;

means for simulating electrically the vibration of the vocal cords, with variable pitch period;

additional means continuously responsive to operator input for controlling said vocal cord pitch variation;

means combining said vocal cord simulation with said frequency response simulation of the vocal tract to produce a resulting waveform; and transducing means to cause the resulting waveform to be emitted as an audible sound.

2. The speech sound generating system of claim 1 further including simulation means to form fricative or plosive consonants and selecting means responsive to operator input for initiating simulation of specific fricative or plosive consonants, said means combining combining said consonant simulation with said vocal cord and vocal tract simulation to produce a combined waveform which is emitted by said transducing means as said audible sound.

3. The speech sound generating system of claim 1 wherein said means continuously responsive to operator input measures motion in two substantially perpendicular directions;

transducer means to resolve said motion into components in the two substantially perpendicular directions;

frequency tuning means whereby one of each of said components of motion affects the frequency location of one of each of said resonant peaks or formants.

4. The speech sound generating system of claim 3 wherein said motion in two substantially perpendicular directions takes place upon a surface.

5. The speech sound generating system of claim 4 wherein said additional means continuously responsive to operator input is also located upon said surface and consists of transducer means for sensing the net force exerted by the operator upon said surface.

6. The speech sound generating system of claim 4 wherein the additional means continuously responsive to operator input is a variable resistance contact which produces an increase in the frequency of said vocal cord pitch when the force is exerted by the operator upon said variable resistance contact.

7. The speech sound generating system of claim 3 wherein said transducer means to resolve said motion into components in the two substantially perpendicular directions is a two-axis potentiometric device.

8. The speech sound generating system of claim 3 further including simulation means to form fricative or plosive consonants and selecting means responsive to operator input for initiating simulation of specific fricative or plosive consonants, said means combining combining said consonant simulation with said vocal cord and vocal tract simulation to produce a combined waveform which is emitted by said transducing means as said audible sound.

9. The speech sound generating system of claim 1 wherein said means for simulating electrically the vibration of the vocal cords comprises a vocal tract simulation circuit having an amplification ratio, and wherein said means continuously responsive to operator input for controlling the location of said formants causes voltages to vary in response to said operator input, and said voltages are applied to control the amplification ratio of said vocal tract simulation circuit through multiplication or division of signal amplitudes in one or more circuit branches, thus controlling the frequency location of said resonant peaks or formants.

10. The speech sound generating system of claim 9 wherein said voltages are obtained in digitized form, and said multiplication or division of signal amplitudes is done digitally.

11. The speech sound generating system of claim 1 wherein said means continuously responsive to operator input and said additional means utilize the amplification of myo-electric or neuro-electric potentials obtained from selected locations on the body of the user.

12. The speech sound generating system of claim 1 further including selection means derived from additional myo-electric or neuro-electric potentials for initiating the simulation of specific fricative or plosive consonants, and means to form the simulation of said fricative consonants and combine said consonant simulation with said vocal tract simulation.

13. The speech sound generating system of claim 1 wherein said means for simulating the frequency response of the vocal tract consists essentially of:

an integrated circuit voice synthesizer with a multiplicity of poles formed by digital recursive filtering;

means to continually load the digital coefficients required by said digital recursive filter in order to cause the formant turning of said integrated circuit voice synthesizer to vary simultaneously and continuously in response to said means continuously responsive to operator input for controlling the frequency locations of said formants.

14. The speech sound generating system of claim 13 further including digitally encoded consonant speech sound data stored in a manner to be accessible for transfer to said integrated circuit voice synthesizer, selection means responsive to operator input for initiating simulation of specific fricative or plosive consonants, means for causing the transfer of said encoded consonant speech sound data for the selected fricative or plosive consonant into said integrated circuit speech synthesizer, and means for returning said speech synthesizer to the simulation of the frequency response of the vocal tract when said encoded consonant speech sound data has been processed.

15. The speech sound generating system of claim 3 further including:

a plurality of programmed function generators;

each of said function generators receiving as input the two said components of motion in the two said substantially perpendicular directions;

each of said function generators producing dependent output signals as predetermined functions of said inputs;

means responsive to said dependent output signals for controlling the frequency locations of resonant peaks or formants which are associated with each of said function generators; and signal combining means for the summation of said resonant peaks or formants into the simulation of the vocal tract.

16. The speech sound generating system of claim 3 wherein said transducer means to resolve said motion into components consists essentially of:

a movable first surface;

said first surface containing a conductive coating on its underside with electrical connection thereto;

a fixed second surface;

said second surface containing a resistive coating of between 100 to 100,000 ohms per square;

a plurality of insulated spacers located between said first and second surfaces to cause said first and second surfaces to be non-contacting in the absense of external force on said first surface;

a plurality of spaced electrical connections to said second surface;

said spaced electrical connections arranged around the perimeter of a substantially rectangular area, with provision to cause a source of fixed potential to be alternately connected across only those of said spaced electrical connections which are on one pair of facing edges of said substantially rectangular area, then connected across only those of said spaced electrical connections which are on a second pair of facing edges, perpendicular to said first pair of facing edges, leaving those of said spaced electrical connections which are alternately not connected free to assume the potential developed in said second surface;

a pair of voltage-detecting devices capable of retaining the value of an input voltage signal during a period in which said input voltage signal is disconnected;

said input voltage of each of said voltage-detecting devices connected to said electrical connection of said first surface in such a manner that one of said voltage-detecting devices is connected when said first pair of facing edges is connected to said fixed potential, and the other of said voltage-detecting devices is connected when said second perpendicular pair of facing edges is connected to said fixed potential; such that pressure applied to a point on said movable first surface will deflect it into contact with said second surface, causing a signal to be delivered to said pair of voltage-detecting devices in synchronism with the application of said fixed potential to said pairs of facing edges so that each of said voltage-detecting devices will produce a voltage proportional to the distance from one of said pairs of facing edges to the point of application of force.

17. The speech sound generating system of claim 16 wherein said first surface is marked or embossed with symbols representing sounds to be generated.

18. The speech sound generating system of claim 3 wherein said transducer means to resolve said motion into components consists essentially of:

a movable first surface;

a conductive coating on the bottom side of said movable first surface with electrical connection thereto;

a movable second surface;

a resistive coating of between 100 and 100,000 ohms per square on the top side of said movable second surface, including spaced parallel conductors along two edges of said resistive coating with provision to apply a fixed potential to said conductors causing a voltage gradient in a first coordinate direction;

a conductive coating on the bottom side of said movable second surface with electrical connection thereto;

a fixed third surface;

a resistive coating of between 100 and 100,000 ohms per square on the top side of said third surface, including spaced parallel conductors along two edges of said resistive coating oriented substantially perpendicular to said spaced parallel conductors of said second surface with provision to apply a fixed potential to said conductors causing a voltage gradient in a second coordinate direction;

a plurality of insulated spacers located between said first and second surfaces, and between said second and third surfaces, to cause said first and second surfaces and said second and third surfaces to be noncontacting in the absence of external force on said first surface, such that pressure applied to a point on said first movable surface of such magnitude as to cause deflections around said insulated spacers will cause contact between said conductive coating on said first movable surface and said resistive coating on said second movable surface, with a voltage delivered to said electrical connection of said first surface proportional to the component of motion in said first coordinate direction; and contact between said conductive coating on said second movable surface and resistive coating on said third fixed surface will result in voltage delivered to said electrical connection of said second surface proportional to the component of motion in said second coordinate direction.

19. The speech sound generating system of claim 18 wherein said first surface is marked or embossed with symbols representing sounds to be generated.

20. The speech sound generating system of claim 3 wherein said means continuously responsive to operator input consists essentially of:

a movable first surface;

a fixed second surface;

a conductive coating under said movable first surface, and a resistive coating on said fixed second surface, arranged to have alternately perpendicular directions of voltage gradient supplied to said resistive coating through switched connection to a source of fixed potential; and voltage-detection means for timed decommutation of the voltage transmitted from said conductive coating underlying said movable first surface as picked up from contact with said resistive coating, into one signal for the component of motion in each of two coordinate directions.

21. The speech sound generating system of claim 3 wherein said means continuously responsive to operator input consists essentially of:

a movable first surface;

a conducting coating underlying said first movable surface;

a movable second surface;

a resistive coating on said movable second surface and a conducting coating underlying said movable second surface;

a fixed third surface;

a resistive coating on-said fixed third surface;

a fixed electric potential applied through spaced parallel conductors to said resistive coating on said movable second surface, and a similar fixed electric potential applied through spaced parallel conductors to the resistive coating on said fixed third surface, being substantially perpendicular to the direction applying said fixed electric potential to said second surface, so that signals delivered from said conductive coatings underlying said first and second surfaces are proportional to the coordinate of motion in each of two coordinate directions.

22. The speech sound generating system of claim 1 wherein said means continuously responsive to operator input consists essentially of:

three or more force-sensitive transducers located on the perimeter of a rigid surface;

ratio-detecting means for producing voltage signals in two or more coordinate directions relating to to the comparison of force magnitude at each of said force-sensitive transducers to the sum of forces at all of said force-sensitive transducers.

23. The speech sound generating system of claim 1 wherein said means for simulating electrically the vibration of the vocal cords, with variable pitch period consists essentially of:

a first slope-determining circuit which produces a ramp-voltage in time;

the slope of said ramp-voltage varying in proportion to a voicing control voltage, said voicing control voltage responding essentially proportionally to the intensity of force exerted by the operator upon an input transducer;

a first voltage-threshold determining circuit which is activated during the rising portion of said ramp-voltage in time;

said voltage-threshold circuit remaining active for a predetermined time of between 0.01 millisecond to 0.9 millisecond;

an inflection or pause in the rate of rise of said ramp-voltage during the time said first voltage-threshold detecting circuit is active;

a second voltage-threshold determining circuit which is activated by said ramp-voltage reaching a predetermined maximum;

slope changing means operating upon said first slope-determining circuit to reverse the direction of slope into a decreasing voltage amplitude with time while said second voltage-threshold determining circuit is active;

a magnitude of said reverse direction of slope which is in fixed ratio to the magnitude of slope set by said first slope-determining circuit;

reset means to deactivate said second voltage-threshold determining circuit when said ramp voltage has decreased to a predetermined minimum value;

biasing means to hold said ramp-voltage at a substantially zero value when said force exerted by the operator is removed; and circuit connection means to deliver said ramp-voltage to said vocal tract simulation.

24. The speech sound generating system of claim 23 further including a fixed magnitude, predetermined time-duration signal acting to further discharge said ramp-voltage from said predetermined minimum value and hold it in a substantially zero voltage value until said predetermined time expires.

25. A control arrangement for a speech sound generating system, said speech sound generating system comprising:

means for simulating the frequency response of the vocal tract, said frequency response including two or more resonant peaks or formants movable in frequency;

means for simulating electrically the vibration of the vocal cords, with variable pitch period;

means for combining said vocal cord simulation with said frequency response simulation of the vocal tract to produce a resulting waveform; and transducing means to cause the resulting waveform to be emitted as an audible sound;

said control arrangement comprising;

means continuously responsive to operator input for simultaneously and continuously controlling the frequency locations of all said formants; and additional means continuously responsive to operator input for controlling said vocal cord pitch variation.

26. An arrangement as defined in claim 25 wherein said system further comprises simulation means to form fricative or plosive consonants;

said means combining combining said consonant simulation with said vocal cord and vocal tract simulation to produce a combined waveform which is emitted by said transducing means as said audible sound;

said arrangement further comprising:

selection means responsive to operator input for initiating simulation of specific fricative or plosive consonants.

27. The arrangement as defined in claim 25 said means continuously responsive to operator input measures motion into substantially perpendicular directions;

and further including transducer means to resolve said motion into components in the two substantially perpendicular directions;

said system further including frequency tuning means;

whereby one of each of said components of motion affects the frequency location of one of each of said resonant peaks or formants.

28. The arrangement as defined in claim 27 and comprising a playing surface;

said motion into substantially perpendicular directions taking place upon said playing surface.

29. An arrangement as defined in claim 28 wherein said additional means continuously responsive to operator input for controlling said vocal pitch variation is also located upon said playing surface and consists of a transducer means for sensing the net force exerted by the operator upon said playing surface.

30. The arrangement as defined in claim 28 wherein said additional means continuously responsive to operator input is a variable resistance contact which produces an increase in the frequency of said vocal cord pitch when the manual of force upon said playing surface is increased.

31. The arrangement as defined in claim 27 wherein said transducer means to resolve said motion in the components in the two substantially perpendicular directions is a two-axis potentiometric device.

32. An arrangement as defined in claim 27 wherein said system further comprises simulation means to form fricative or plosive consonants;

said means combining combining said consonant simulation with said vocal cord and vocal tract simulation to produce a combined waveform which is emitted by said transducing means as said audible sound;

said arrangement further comprising:

selection means responsive to operator input for initiating simulation of specific fricative or plosive consonants.

33. An arrangement as defined in claim 27 wherein, in said system, said means for simulating electrically the vibration of the vocal cords comprises a vocal tract simulation circuit having an amplification ratio;

said means continuously responsive to operator input for controlling the location of said formants causing voltages to vary in response to said operator input;

whereby, said voltages are applied to control the amplification ratio of said vocal tract simulation circuit through multiplication or division of signal amplitudes in one or more circuit branches, thus controlling the frequency location of said formants.

34. An arrangement as defined in claim 27 wherein said transducer means to resolve said motion into components consists essentially of:

a movable first surface;

said first surface containing a conductive coating on its underside with electrical connection thereto;

a fixed second surface;

said second surface containing a resistive coating of between 100 to 100,000 ohms per square;

a plurality of insulated spacers located between said first and second surfaces to cause said first and second surfaces to be non-contacting in the absence of external force on said first surface;

a plurality of spaced electrical connections to said second surface;

said spaced electrical connections arranged around the perimeter of a substantially rectangular area, with provision to cause a source of fixed potential to be alternately connected across only those of said spaced electrical connections which are on one pair of facing edges of said substantially rectangular area, then connected across only those of said spaced electrical connections which are on a second pair of facing edges, perpendicular to said first pair of facing edges, leaving those of said spaced electrical connections which are alternately not connected free to assume the potential developed in said second surface;

a pair of voltage-detecting devices capable of retaining the value of an input voltage signal during a period in which said input voltage signal is disconnected;

said input voltage of each of said voltage-detecting devices connected to said electrical connection of said first surface in such a manner that one of said voltage-detecting devices is connected when said first pair of facing edges is connected to said fixed potential, and the other of said voltage-detecting devices is connected when said second perpendicular pair of facing edges is connected to said fixed potential; such that pressure applied to a point on said movable first surface will deflect it into contact with said second surface, causing a signal to be delivered to said pair of voltage-detecting devices in synchronism with the application of said fixed potential to said pairs of facing edges so that each of said voltage-detecting devices will produce a voltage proportional to the distance from one of said pairs of facing edges to the point of application of force.

35. An arrangement as defined in claim 34 wherein said first surface is marked or embossed with symbols representing sounds to be generated.

36. An arrangement as defined in claim 27 wherein said transducer means to resolve said motion into components consists essentially of:

a movable first surface;

a conductive coating on the bottom side of said movable first surface with electrical connection thereto;

a movable second surface;

a resistive coating of between 100 and 100,000 ohms per square on the top side of said movable second surface, including spaced parallel conductors along two edges of said resistive coating with provision to apply a fixed potential to said conductors causing a voltage gradient in a first coordinate direction;

a conductive coating on the bottom side of said movable second surface with electrical connection thereto;

a fixed third surface;

a resistive coating of between 100 and 100,000 ohms per square on the top side of said third surface, including spaced parallel conductors along two edges of said resistive coating oriented substantially perpendicular to said spaced parallel conductors of said second surface with provision to apply a fixed potential to said conductors causing a voltage gradient in a second coordinate direction;

a plurality of insulated spacers located between said first and second surfaces, and between said second and third surfaces, to cause said first and second surfaces and said second and third surfaces to be noncontacting in the absence of external force on said first surface, such that pressure applied to a point on said first movable surface of such magnitude as to cause deflections around said insulated spacers will cause contact between said conductive coating on said first movable surface and said resistive coating on said second movable surface, with a voltage delivered to said electrical connection of said first surface proportional to the component of motion in said first coordinate direction; and contact between said conductive coating on said second movable surface and resistive coating on said third fixed surface will result in voltage delivered to said electrical connection of said second surface proportional to the component of motion in said second coordinate direction.

37. An arrangement as defined in claim 36 wherein said first surface is marked or embossed with symbols representing sounds to be generated.

38. An arrangement as defined in claim 27 wherein said means continuously responsive to operator input consists essentially of;

a movable first surface;

a fixed second surface;

a conductive coating under said movable first surface, and a resistive coating on said fixed second surface, arranged to have alternately perpendicular directions of voltage gradient supplied to said resistive coating through switched connection to a source of fixed potential; and voltage-detection means for timed decommutation of the voltage transmitted from said conductive coating underlying said movable first surface as picked up from contact with said resistive coating, into one signal for the component of motion in each of two coordinate directions.

39. An arrangement as defined in claim 27 wherein said means continuously responsive to operator input consists essentially of:

a movable first surface;

a conducting coating underlying said first movable surface;

a movable second surface;

a resistive coating on said movable second surface and a conducting coating underlying said movable second surface;

a fixed third surface;

a resistive coating on said fixed third surface;

a fixed electric potential applied through spaced parallel conductors to said resistive coating on said movable second surface, and a similar fixed electric potential applied through spaced parallel conductors to the resistive coating on said fixed third surface, being substantially perpendicular to the direction applying said fixed electric potential to said second surface, so that signals delivered from said conductive coatings underlying said first and second surfaces are proportional to the coordinate of motion in each of two coordinate directions.

40. An arrangement as defined in claim 25 wherein said means continuously responsive to operator input consists essentially of:

three or more force-sensitive transducers located on the perimeter of a rigid surface;

ratio-detecting means for producing voltage signals in two or more coordinate directions relating to the comparison of force magnitude at each of said force-sensitive transducers to the sum of forces at all of said force-sensitive transducers.

* * * * *